US011889961B1

(12) United States Patent
Bisson et al.

(10) Patent No.: US 11,889,961 B1
(45) Date of Patent: Feb. 6, 2024

(54) FLOOR SCRUBBER APPARATUS WITH VACUUM MOTOR PROTECTION

(71) Applicant: Karma 360, Inc., Huntington Beach, CA (US)

(72) Inventors: Montgomery Bisson, Huntington Beach, CA (US); Jesus J. Peña, Yorba Linda, CA (US)

(73) Assignee: KARMA 360, INC., Huntington Beach, CA (US)

( * ) Notice: Subject to any disclaimer, the term of this patent is extended or adjusted under 35 U.S.C. 154(b) by 91 days.

(21) Appl. No.: 17/545,816

(22) Filed: Dec. 8, 2021

Related U.S. Application Data

(60) Provisional application No. 63/123,013, filed on Dec. 9, 2020.

(51) Int. Cl.
*A47L 11/40* (2006.01)
*A47L 11/30* (2006.01)

(52) U.S. Cl.
CPC ..... *A47L 11/4016* (2013.01); *A47L 11/305* (2013.01); *A47L 11/4044* (2013.01)

(58) Field of Classification Search
CPC .. A47L 11/4016; A47L 11/305; A47L 7/0023; A47L 11/4044; A47L 11/4083; A47L 11/4013; B60K 15/067; F17C 13/084; F17C 2201/00
USPC ..... 15/320, 49.1; 220/480, 477, 385; 224/420, 425
See application file for complete search history.

(56) References Cited

U.S. PATENT DOCUMENTS 5,967,747 A * 10/1999 Burke ..... A47L 5/22 415/206
7,216,397 B1 * 5/2007 Tanner ..... B08B 3/14 15/340.1
7,937,801 B2 * 5/2011 Egler ..... A47L 5/30 15/327.2

(Continued)

FOREIGN PATENT DOCUMENTS

DE 102009030583 A1 * 4/2010 ..... B60K 15/067

OTHER PUBLICATIONS

Translation of DE102009030583A1 (Year: 2023).*

*Primary Examiner* — Steven M Cernoch
*Assistant Examiner* — Sarah Akyaa Fordjour
(74) *Attorney, Agent, or Firm* — Rod D. Baker

(57) ABSTRACT

A walk-behind floor microscrubber apparatus. The microscrubber includes as main subassemblies an upright handle assembly pivotally connected to a base assembly. The handle assembly includes components for recovering a cleaning solution applied to the floor during cleaning operations. The base assembly houses electrically powered motors for driving scrubbing brushes, and a clean solution reservoir. Spent cleaning solution applied to the floor is sucked to a recovery tank on the handle assembly. The microscrubber has features for avoiding vacuum motor flooding, including a specially-shaped recovery tank. Chambers in the recovery tank capture used cleaning solution when the handle assembly is tilted, thereby reducing the likelihood of solution travelling back to the vacuum motor. The microscrubber also has an exoskeleton reserve tank in the handle assembly. The exoskeleton reserve tank serves as a reserve "backup," to the chambered recovery tank, offering redundant protection against flooding to the vacuum motor.

22 Claims, 13 Drawing Sheets

(56) References Cited

U.S. PATENT DOCUMENTS

| | | | | |
|---|---|---|---|---|
| 2005/0034266 | A1* | 2/2005 | Morgan | A47L 11/4044 15/354 |
| 2021/0330149 | A1* | 10/2021 | Krebs | A47L 11/4094 |

* cited by examiner

FLOOR SCRUBBER APPARATUS WITH VACUUM MOTOR PROTECTION

CROSS-REFERENCE TO RELATED APPLICATIONS

This application claims the benefit of U.S. Provisional Patent Application Ser. No. 63/123,01 entitled "Floor Scrubber Apparatus With Vacuum Motor Protection," filed on 9 Dec. 2020, the entire disclosure of which is incorporated by reference. This application is related to U.S. patent application Ser. No. 17/147,880 entitled "Floor Scrubber Apparatus with Releasably Locking Handle" filed 10 Sep. 2021, and the entire disclosure thereof is hereby incorporated by reference.

BACKGROUND OF THE INVENTION

Field of the Invention

This invention relates to upright floor scrubber machines, particularly to an upright scrubber/dryer including features for fluid management and protecting the vacuum motor from fluid damage.

Background of the Invention

Walk-behind powered floor scrubber machines are long known in the art as useful for cleaning floors by a scrubbing action. Small upright floor scrubbers devised for walk-behind (as distinguished from riding) operation by a single person are sometimes called "microscrubbers." The user grasps a handle assembly which is connected to a base assembly. The handle assembly is used to control the operation of the base assembly, which base assembly contains the cleaning components (e.g., brushes or pads) that contact and clean the surface of the floor as the microscrubber moves across the floor.

Most known microscrubbers are for wet cleaning action, in which the device supplies a cleaning solution, typically water or water with diluted cleaning chemical, to the floor during the scrubbing action. Some existing microscrubbers are self-propelled, via brush-assisted action or through a drive motor, such that the user need only steer and control the device without having also to provide the main motive force to push/pull the device across the floor. Microscrubbers often are electrically powered by means gran electrical cord that into a wall socket of the building structure whose floor is to be cleaned or alternatively, are battery powered. In either case, the electrical power is harnessed to energize one or more motors in the device, which include fluid pumps/motors and one or more scrubbing motors or elements.

During operation, the microscrubber device applies water, often from an onboard supply tank and sometimes mixed with detergents or other cleaning agents, to the floor, while powered scrubbing elements (usually one or more rotating counter-rotating bristle brushes) provide a scouring or scrubbing action to the wetted floor. Squeegee components may be provided in a trailing location behind the scrubbing elements to wipe the floor dry and to collect the used water, typically via a vacuum pump action or vacuum motor, which used water may be pumped or sucked back up into a separate waste or solution recovery tank.

As mentioned, microscrubbers typically feature a base assembly from which a handle assembly extends upward. The handle assembly may have a pivotal connection to the base assembly to permit the user to pivot the handle assembly, relative to the base assembly, during operation to enhance versatility of use and ease of steering. The base assembly has a frame and/or housing which mounts the scrubbing element(s) for powered rotary movement while in contact with the floor. In known types of microscrubbers, the base unit usually also contains the motor(s) which drive the scrubbing element(s). The handle assembly has some type of handle grip(s) with which the user steers the microscrubber across the floor during use; various control switches typically also are provided on the handle assembly, on or near the grip(s), for regulating the electrically powered functions of the device.

Microscrubber devices typifying the state of the art are disclosed by, for example: U.S. Patent Application Publication No. 2019/0343357 by Franke, and U.S. Patent Application Publication No. 2013/0133146 by Brueckner et al., which are incorporated herein by reference.

Microscrubbers with tiltable handle assemblies are vulnerable to damage to the vacuum motor or vacuum pump which pulls cleaning fluid through the device's system. In some devices, the top of the cleaning fluid recovery tank is potentially in open fluid communication with a channel (perhaps a vacuum channel) or cavity leading to the vacuum motor. Consequently, when the handle assembly is tipped or tilted angularly downward a substantial distance toward the horizontal, it may happen that cleaning solution unintentionally exits the top of the recovery tank, enters the vacuum channel, and then travels back to the vacuum motor. Solution reaching the vacuum motor may, and often does, disable or destroy the vacuum pump/motor.

Known microscrubber devices employ mechanical means for preventing solution backflow toward the system's vacuum motor. Such mechanical means typically employ ball or cup floats to check backflow from the spent solution recovery tank; or some incorporate an electronic float shut-off system whereby the actuation of a float shuts off power to the system. Mechanical or electronic float shutoffs can become laden or encrusted with debris, sludge, gunks and residue in the cleaning solution in the recovery tank, which fouling compromises float-based flood prevention. Consequently, despite theses known attempts to prevent harmful solution backflow out of a solution recovery tank, accidental flooding remains the leading cause of vacuum motor failure in conventional microscrubber devices.

Thus, there is an unmet need for a floor microscrubber device with a versatile pivotal handle assembly that permits the handle to be tilted through substantial degrees toward horizontal, and yet is reliably safeguarded against vacuum motor flooding, even after repeated extended periods of use. With the foregoing background the present invention was developed.

SUMMARY OF THE INVENTION

There is disclosed an upright walk-behind microscrubber apparatus, featuring an improved handle function and feature. The microscrubber includes as main subassemblies an upright handle assembly pivotally connected to a base assembly. The handle assembly is manipulated by the user to steer and operate the apparatus, and has a pair of handle grips which the user manually grasps the apparatus during operation. A control panel at the top end of the handle assembly includes various switches, including on-off toggle switches, for regulating the electrically powered components (e.g., pumps, scrubber brushes) of the apparatus. The handle assembly includes various pumping, tubing, and container components recovering the aqueous cleaning solution applied to the floor during floor cleaning operations. The base assembly houses one or more electrically powered motors for driving one or more disc or rotary scrubbing brushes for scrubbing a floor and a clean solution reservoir holding clean aqueous cleaning solution. The base assembly also includes a squeegee assembly and vacuum motor for recovering from the floor the water the apparatus has applied to the floor. Alternatively, the vacuum motor can also be located on the handle instead of the base. Water is pumped to the brush(es) from a clean solution reservoir or supply tank on the base of the unit via a flexible delivery tube, while used "dirty" water collected under the base assembly and in front of the squeegee assembly is sucked, via an intake flow conduit, back to the handle assembly and ultimately to a recovery tank thereon.

The inventive apparatus provides features specifically devised for reducing or eliminating vacuum motor flooding from the solution recovery tank. One advantageous feature is a specially shaped and configured solution recovery tank having water traps that help prevent vacuum motor flooding. Traps of chambers formed into the recovery tank capture used or "dirty" cleaning water/solution as the axis of the microscrubber's handle assembly is lilted downward (away from vertical toward horizontal), thereby reducing the likelihood water/solution travelling back to the vacuum motor. The chambers formed in the recovery tank also serve advantageously as "anti-sloshing" wave breaks or baffles while the handle assembly is pivotally lowered.

Another aspect of the disclosed microscrubber is the provision of an exoskeleton reserve tank in the apparatus's handle assembly. The specially configured exoskeleton reserve tank serves as a reserve "backup" to the chambered recovery tank, offering redundant protection against flooding to the vacuum motor. Should foam or moisture migrate past the chambers in the primary recovery tank, the apparatus's exoskeleton body functions as a reserve tank, further protecting the vacuum motor.

Also provided according to the present apparatus is a particularly devised foam and moisture management system. Should foam or moisture (from spent cleaning fluid) inadvertently migrate into the exoskeleton reserve tank, a float-triggered switch actuates a pump which evacuates foam and/or fluid from within the exoskeleton. The evacuated foam and/or moisture is reintroduced back into the primary recovery tank. The foam and moisture management system serves as a tertiary safeguard against harmful overflows and flooding.

This summary characterizes generally the invention that is disclosed herein; it is not intended to be limiting of the invention.

BRIEF DESCRIPTION OF THE DRAWINGS

The attached drawings, which form part of this disclosure, are as follows.

The views are not necessarily to scale, either between views or within a particular view. Similar elements and components are identified with label numerals in the several views. The user walks behind the apparatus, and thus sees the "rear" of the apparatus during use.

DETAILED DESCRIPTION OF THE INVENTION

The invention relates to a motorized apparatus for cleaning floors, being an upright walk-behind "microscrubber, " with elements and systems for protecting the apparatus's vacuum motor against harmful flooding. The apparatus affords excellent maneuverability which allows it to be used in small to medium areas that have typically been maintained previously by manual mop and bucket methods. The apparatus holds clean, unused, cleaning solution in a reservoir on a base assembly, which solution is dispensed onto the floor, with one or (typically) two counter-rotating brushes scrubbing the floor, and a squeegee and vacuum motor system which recovers the dirty solution into a primary recovery tank mounted on a handle assembly, thereby providing "single pass" cleaning. The disclosed microscrubber offers simplicity of service and operation, while providing a robust overall apparatus. A preferred embodiment is powered by one single lithium battery of known type, but this is by way of preference, not limitation; two or more batteries are suited as well. The battery(ies) provides at least a one-hour runtime and approximately one-hour charge/recovery period.

Figure 1:
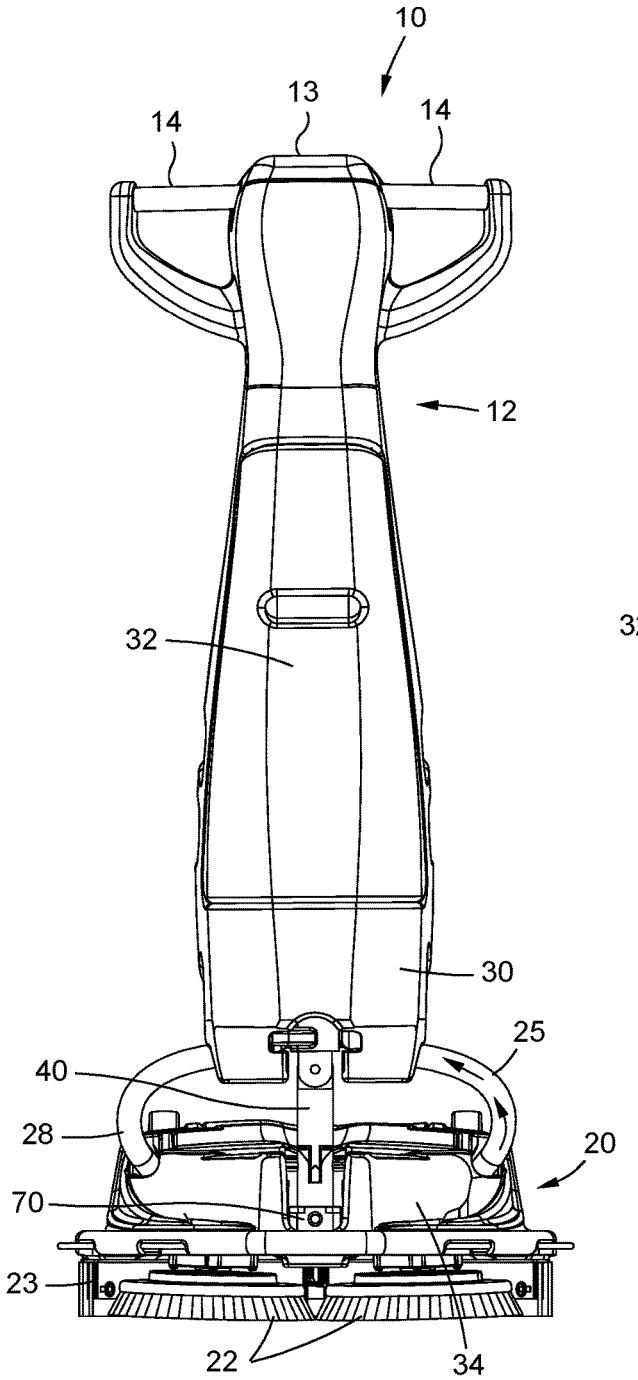
FIG. 1 is a front of a microscrubber apparatus according to one preferred embodiment of the present invention, showing a base assembly and a handle assembly thereof.
Figure 2:
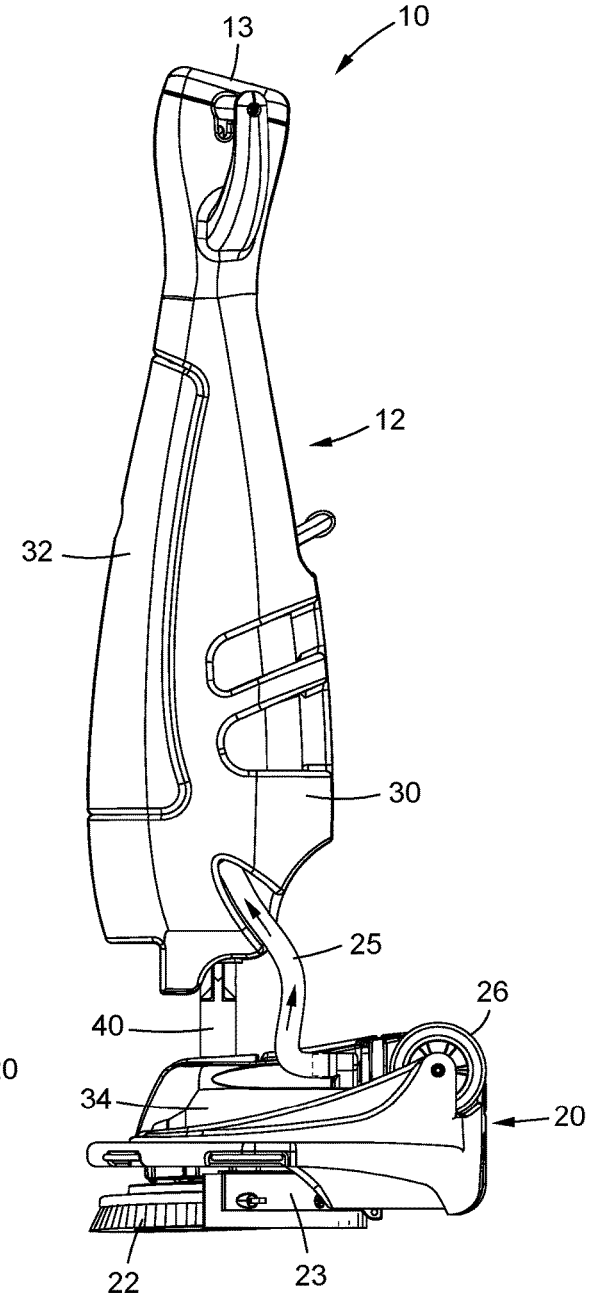
FIG. 2 is a left side view of microscrubber apparatus according to one preferred embodiment of the present invention, showing a base assembly and a handle assembly thereof.
Figure 3:
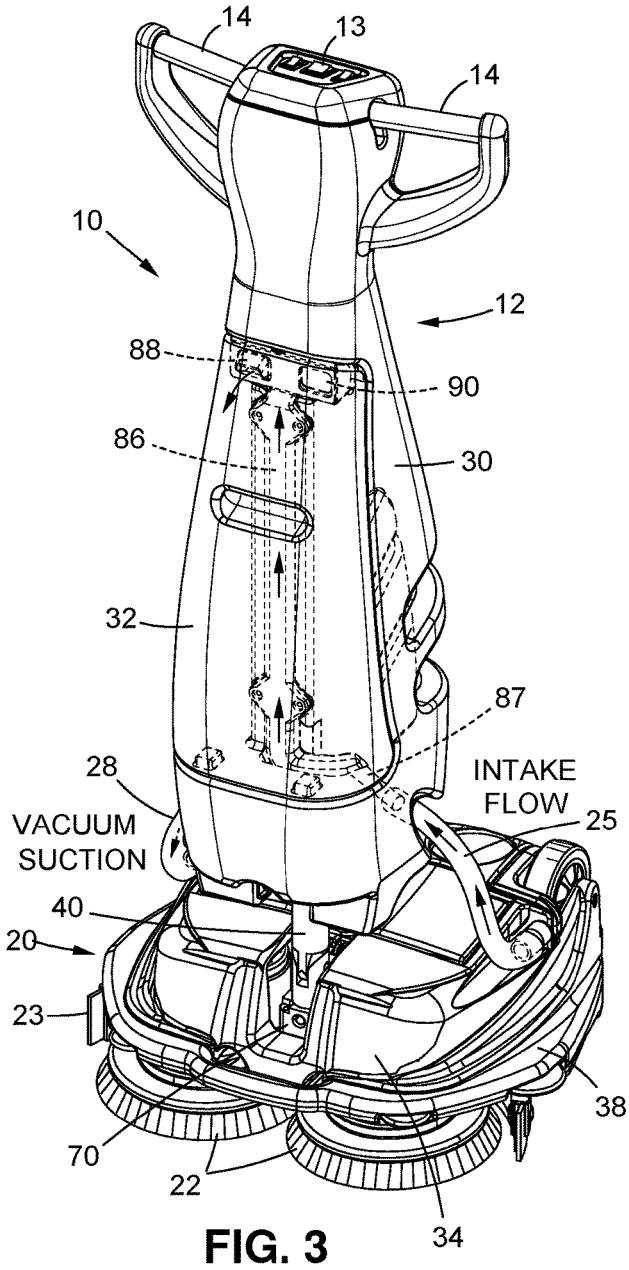
FIG. 3 is a perspective front view, from above, of the apparatus shown in FIG. 1, and with selected internal features shown in dashed hidden lines.

Combined reference to FIGS. 1-6 provides an overview of an upright microscrubber apparatus 10 according to the present disclosure; FIGS. 1 and 2 are front and left side views, FIG. 3 is a perspective front view, and FIG. 4 offers a perspective rear view. The floor cleaning microscrubber 10 has an upright handle assembly 12 pivotally but reliably connected to a base assembly 20.

The handle assembly 12 includes elements to provide rigidity and structural integrity for the apparatus 10. The handle assembly 12 is manipulated the user to steer and operate the apparatus 10 by use of the handle grips 14. Handle assembly 12 has a pair of handle grips 14 by which the user manually grasps the apparatus 10 during operation. A control panel 13 at the top end of the handle assembly 12 includes various switches, including for example on-off toggle switches, for regulating the electrically powered components of the apparatus 10. As shall be further described, handle assembly 12 also has various pumping, tubing, and container components for recovery of the spent aqueous cleaning solution that was applied to the floor during floor cleaning operations.

The base assembly 20 also has base structural elements, including a rigid main platform 38 (e.g., FIGS. 3, 7, and 8) to lend foundational support and integrity to the apparatus 10. Base assembly 20 houses one or more electrically powered motors 42 (FIG. 7) for driving a pair of rotary scrubbing brushes 22 for scrubbing a floor. The base assembly 20 also has a squeegee assembly 23 and vacuum motor 44 (FIG. 7) for recovering cleaning solution the apparatus 10 has applied to the floor. The squeegee assembly 23 has a flexible blade running along its bottom, which contacts and "wipes" the floor during floor scrubbing operations. Unused (clean) water or cleaning solution is pumped from a clean solution reservoir 34 on the base assembly 20 to the brushes 22 of the base assembly 20, while used "dirty" water collected under the base assembly and in front of the squeegee assembly 23 is sucked or recovered, via an (flexible) intake flow return tube 25, back to the handle assembly to a recovery tank 32 thereon. The base assembly 20 preferably mounts a pair a wheels 26 that facilitate roiling movement and upright disposition of tile apparatus 10 when in a storage position (position not shown, but conventionally known in the art).

Continuing reference is invited to FIGS. 1-6. The handle assembly 12 is movably secured to the base assembly 20 by means of a specialized species of universal joint. The u-joint assembly may include an intermediate linking member 40, which connects a main handle shaft 52 within the handle assembly 12 to a mounting hub 70 on a base plate or platform in the base assembly 20. This universal joint configuration permits the handle assembly 12 to be swiveled, rotated, and tilted, relative to the base assembly 20, in, through, and to a wide variety of positions in three-dimensional space; this positional versatility reduces the physical labor demanded from the user, facilitates steering of the apparatus 10 during use, and allows optimization of the handle assembly position in space while cleaning in and around objects and obstacles upon the floor. A suitable specialized universal joint assembly, include an intermediate linking member 40, which connects a main handle shall 52 within the handle assembly 12 to a mounting hub 70 on a base plate or platform in the base assembly 20, is described in detail in our co-pending U.S. patent application Ser. No. 17/471,880.

Thus it is desirable, during the operation of the apparatus 10 during floor cleaning that the handle assembly 12 be pivotally connected to the base assembly 20 in a manner which permits it to be tilted in any direction, and at practically any angle, relative to the base assembly (and thus also to the floor). While it is conceivable that the handle assembly 12 may briefly be in a vertically upright position during cleaning operations, as seen in FIGS. 1-4, such a strictly upright position is seldom obtained while the apparatus 10 is scrubbing the floor. Rather, attention is advanced to FIGS. 16A-D, depicting selected examples of other positions the handle assembly 12 may assume, in relation to the base assembly 20 during use. These FIGS. 16A-D indicate, by way of example, the need to permit the handle assembly to pivot front-to-back in relation to the base assembly 20 during operation of the apparatus. Thus, the handle assembly 12 is connected to, but widely pivotal in relation to, the base assembly 20. This connection may be by any suitably specialized universal type of joint that permits the handle assembly 12 to be readily pivoted or tilted front-to-back, and side-to-side, by the operator during use.

Referring still to FIGS. 1-6, it is seen that the handle assembly 12 includes a main exoskeleton 30 and a main recovery tank 32 that is removably attachable upon the exoskeleton. Both the exoskeleton 30 and the recovery tank 32 preferably are molded from durable thermoplastics. Both the exoskeleton 30 and the recovery tank 32 are hollow, so as to receive and contain aqueous cleaning solution. The recovery tank 32 is controllably detachable from the exoskeleton 30 of the assembly, to permit the recovery tank when filled with used "dirty" cleaning solution to be removed and its contents emptied to an appropriate waste drain or the like. After being emptied of waste, the recovery tank 32 can be re-inserted onto the exoskeleton 30.

The base assembly 20 includes a clean solution reservoir 34 for holding fresh unused cleaning solution. The clean solution reservoir 34 beneficially is located in the base assembly 20, rather than the handle assembly 12, to reduce the operating weight of the handle assembly and to lower the overall center of gravity of the microscrubber when the clean solution reservoir is full. The clean solution reservoir 34 also is preferably molded from durable and substantially rigid thermoplastic. The solution reservoir 34, although defining, a complex and highly featured and contoured topology (see, e.g., FIG. 7), is hollow to define an interior for containing fresh cleaning solution to be applied to the scrubbing brushes 22 and to the floor. Various elements and components of the base assembly 20 may be fitted on or adjacent the clean solution reservoir 34 as shall be made more apparent hereinafter.

The flow of fluids through the system of the microscrubber apparatus 10 can be understood generally with reference to FIGS. 1-6. Unused cleaning solution is stored in the hollow clean solution reservoir 34 that is a component of the base assembly 20. A conventional pump in the base assembly 20 pumps fresh solution from the solution reservoir 34 and delivers (via tubes and outlets unseen in FIGS. 1-6) the fresh solution onto and/or adjacent the rotating scrubber brushes 22 (generally according to known conventions). The cleaning solution wets the brushes 22 and thereby is applied to the floor to fulfil its wet-cleaning purpose. The microscrubber apparatus 10 moves forward (assisted by the counter-rotation of the scrubbing brushes) as floor scrubbing proceeds. As the apparatus 10 travels forward (e.g., to the left in FIG. 2) under the guidance of the operator, cleaning solution is squeegeed from the floor by the flexible blade of the squeegee assembly 23; the soiled solution collects in front of the squeegee assembly 23.

Figure 4:
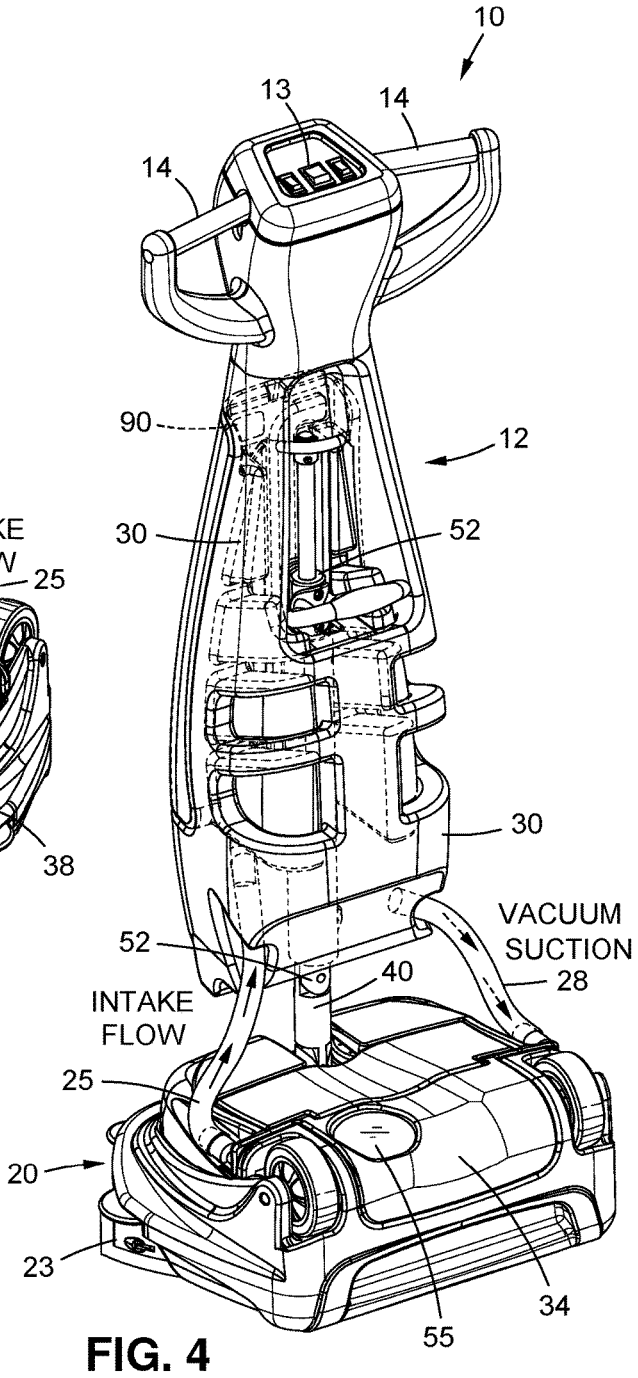
FIG. 4 is a perspective view, from the left, of the rear of the apparatus shown in FIG. 2, with selected internal features shown in dashed hidden lines.

There is a vacuum motor 44, preferably a turbine-type motor (not shown in FIGS. 1-6, but see FIG. 7) disposed within the base assembly 20. The vacuum motor pump 44 is the prime mover of fluids, mainly dirty cleaning solution, through the system of the microscrubber 10. A vacuum suction tube 28 is in fluid communication with and between the vacuum motor pump 44 and the interior of the exoskeleton 30. The vacuum motor moves air at high velocity to "pull" a vacuum (reduced air pressure) within the closed hollow interior of the exoskeleton 30. FIG. 4 depicts with dashed-line directional arrows the suction action, via the suction tube 28, from the vacuum motor 44 in the base assembly 20 to the interior of the exoskeleton 30. There is a sealed connection between the upper end of the suction tube 28 and a port in the lower portion of the exoskeleton 30. Thus a means for pulling a vacuum from the vacuum motor 44 and within the exoskeleton 30 includes at least the suction tube 28. The consequently reduced pressure within the exoskeleton 30 is the secondary driver of soiled fluids (primarily liquid, but often including foam particularly when detergents are used) through the system of the microscrubber 10. The vacuum motor in the base assembly 20, when operating, thereby induces a suction via the vacuum suction tube 28, so to reduce the interior pressure of the exoskeleton 30.

Figure 5:
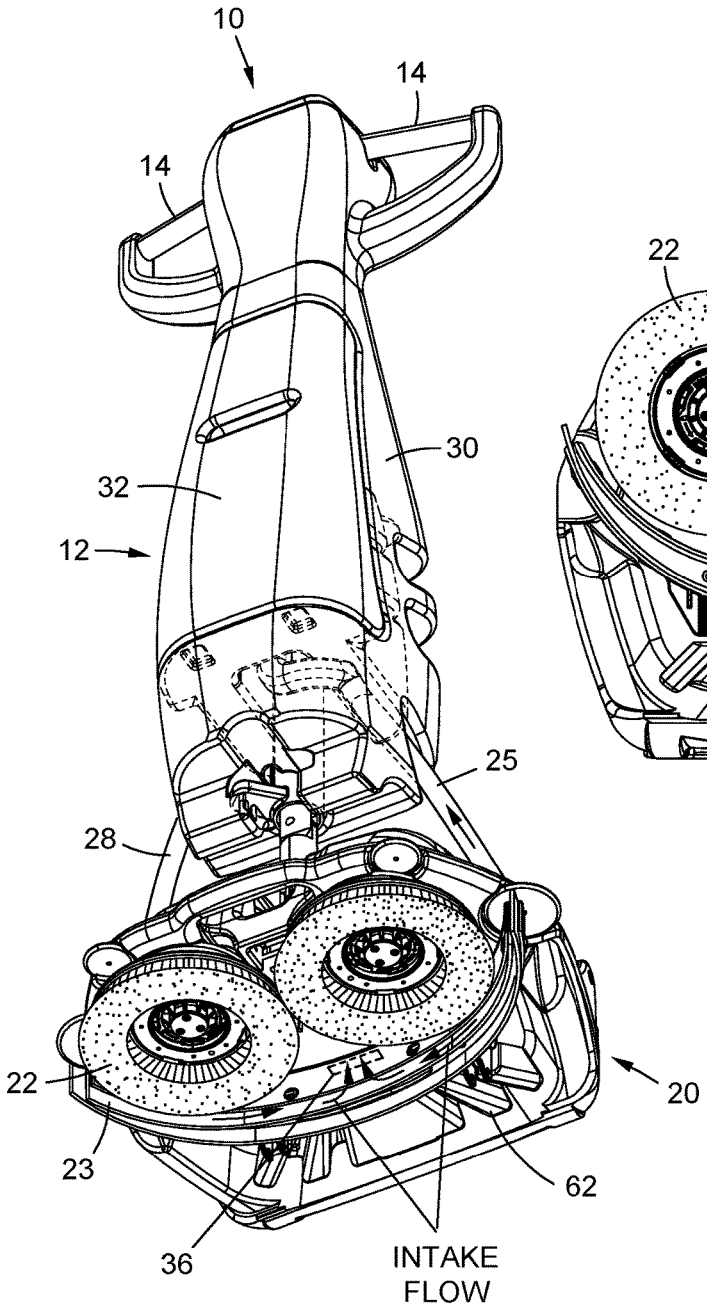
FIG. 5 is a perspective view, from below, of the front of the apparatus shown in FIG. 3, with selected internal features shown in dashed hidden lines.
Figure 6:
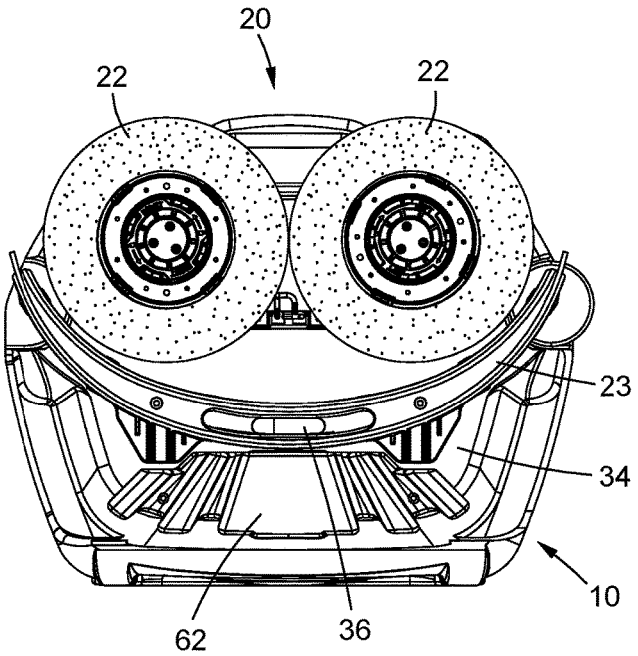
FIG. 6 is a bottom view of the apparatus shown in FIG. 5.

Particular attention is invited to FIGS. 5 and 6. Directional arrows in FIG. 5 illustrate that, as the microscrubber 10 moves forward, an intake flow of dirtied cleaning solution wiped from the floor collects in front of the squeegee assembly 23, and is directed (by the curved squeegee) rearward and inwardly toward an intake port 36 centrally located in the bottom of the base assembly 20. The intake flow seen in FIG. 5 is promoted by both the forward travel of the apparatus 10 and the curvature of the squeegee assembly 23, as well as a suction into the bottom intake port 36. Suction to the intake port 36 is provided by the reduced pressure within the exoskeleton 30 initially by the action of the vacuum motor 44 but the vacuum is pulled through the intake flow tube 25; dirtied cleaning solution is conveyed to the flow tube 25 from the intake port 36 via the flow conduit 47 (FIG. 7) in the base assembly 20.

Referring also to FIGS. 3 and 4, the intake flow tube 25 thus is in direct or indirect connection with, and in fluid communication with, the bottom intake port 36 (FIGS. 5, 6). An upper end of the intake flow tube 25 is in fluid communication (in a manner further to be described) with the hollow interior of the solution recovery tank 32. The interior of the recovery tank 32 also is in communication with the interior of the exoskeleton 30; the interior space within the recovery tank (like the exoskeleton interior) is, during operation, low-pressure. A suction force is transmitted from the recovery tank 32 to the intake flow tube 25 (via recovery conduit 86, FIGS. 3, 9, 10) As a result, cleaning fluid is sucked from the floor (in the vicinity of the squeegee assembly 23) via the bottom intake port 36 and into the intake flow tube 25. FIGS. 1-3 illustrate with solid-line directional arrows the intake flow of dirtied solution upward from the base assembly 20, via the intake flow tube 25, and into the recovery tank 32 of the handle assembly 12. This "spent" cleaning solution accumulates within the recovery tank 32. In this disclosure and the claims, "upward" means generally opposite the vector of gravity, i.e., toward a higher elevation relative to the floor (per FIGS. 16A-D)

Summarizing, the vacuum motor 44 in the base assembly 20 generates low pressure within the interiors of the exoskeleton 30 and recovery tank 32 (suction pulled via vacuum suction tube 28). Fresh cleaning solution is conducted, by the action of a liquid solution pump in the base assembly 20 from within the clean solution reservoir 34 to the scrubbing brushes 22 and to the floor. Contaminated, spent, cleaning solution on the floor is collected in front of the squeegee assembly 23, while the low pressure within the recovery tank 32 induces a auction, via the intake flow tube 25, at the bottom intake port 36. Having additional reference to FIGS. 3 and 9, it is seen that the spent solution collected by the squeegee assembly 23 is sucked from the floor and into the bottom intake port 36 and then conveyed via the intake flow tube 25 to intermediate recovery conduit 86, which ultimately deposits the spent cleaning solution into the recovery tank 32. Spent solution normally remains in the solution recovery tank 32 until it is deliberately emptied from the recovery tank by the user.

Figure 7:
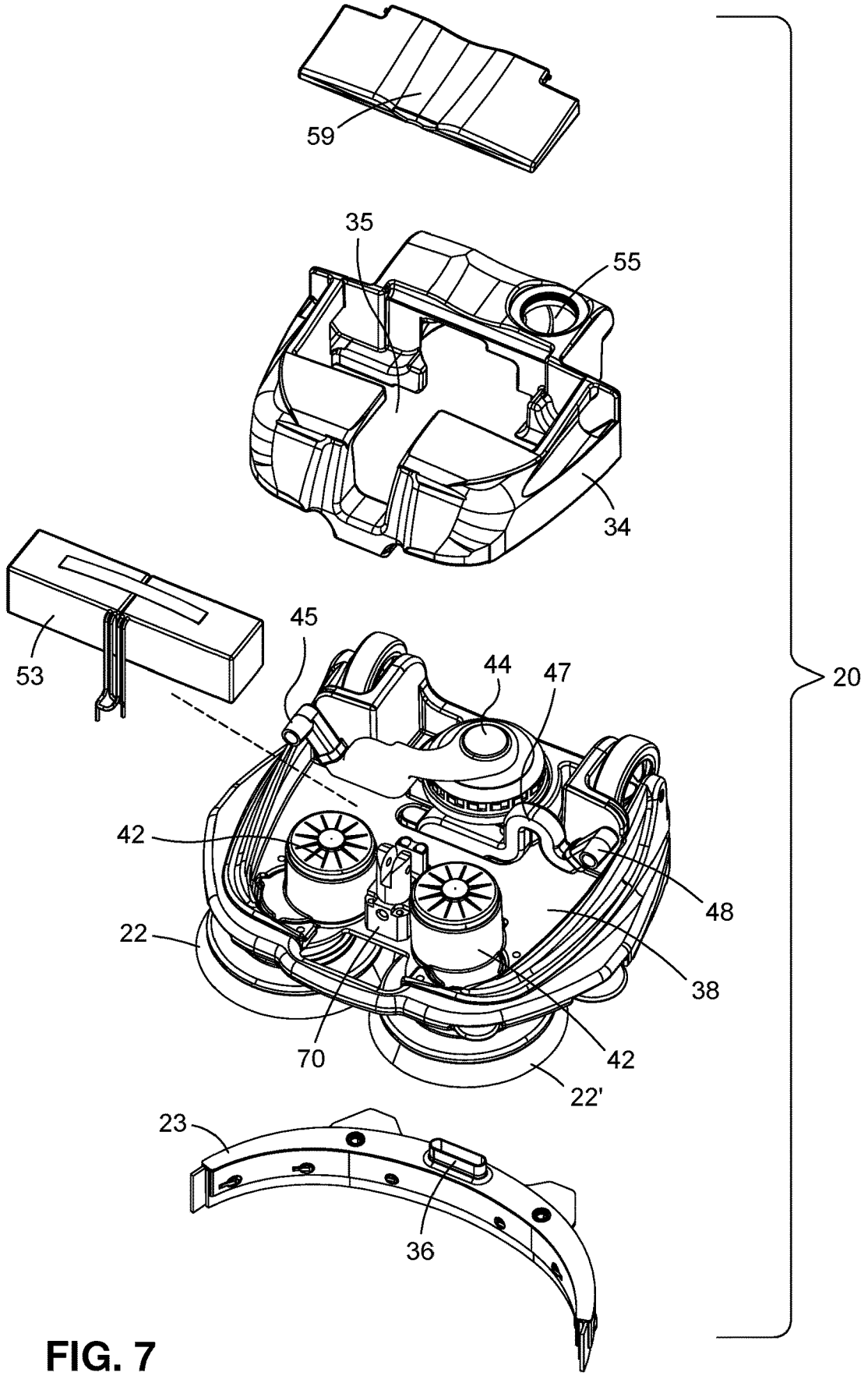
FIG. 7 is an exploded view, from above, of a base assembly of a preferred embodiment of the present invention.
Figure 8:
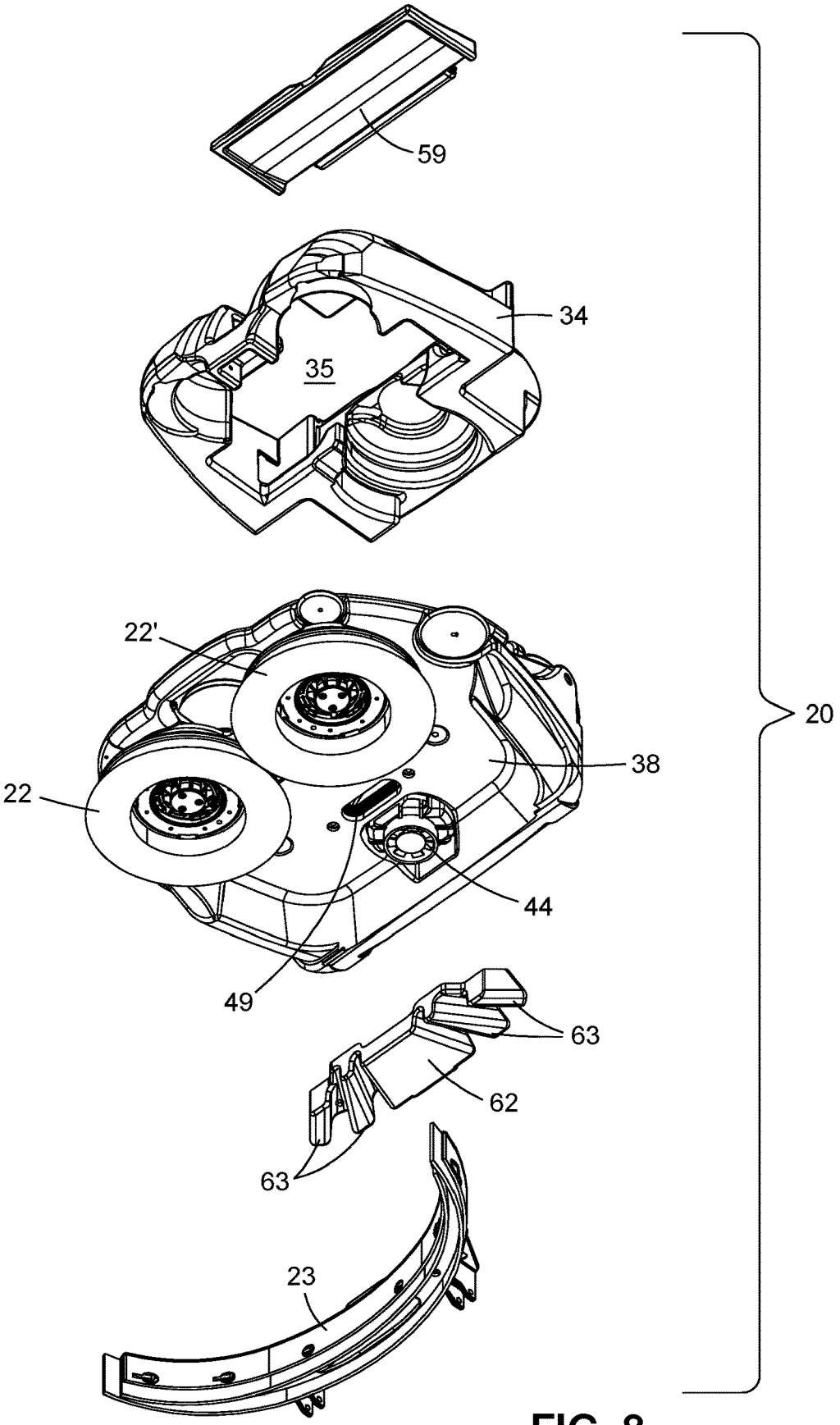
FIG. 8 is an exploded view, from below, of the base assembly shown in FIG. 7.

Attention is advanced to the exploded views of FIGS. 7 and 8, which offer details of a base assembly 20 according to a preferred embodiment of the microscrubber 10. The base assembly 20 features a sturdy main platform 38 serving as a central structural foundation for the base assembly, and which mounts other components thereof. The platform 38 has the mounting hub 70 secured thereto, which hub has an articulated junction with the intermediate linking member 40 (discussed previously herein with reference to FIGS. 1-4). The intermediate linking member 40 in turn has an articulated connection to the main handle shaft 52 (FIG. 4) in the handle assembly 12, whereby the handle assembly securely yet broadly pivotally connected to the base assembly 20.

The base platform 38 mounts the one or more electric motor(s) 42 that impart powered rotation to the scrubbing brushes 22, 22' in a generally conventional manner. In a preferred embodiment, the brushes 22, 22' rotate in opposite directions; the left-side brush 22' rotates counterclockwise as viewed in FIG. 7, while the right-side brush 22 rotates clockwise as seen in that figure. Also seen in FIGS. 7 and 8 is the turbine vacuum motor discussed previously. Vacuum motor 44 "pulls" a suction in the vacuum suction tube 28 (FIGS. 1-5), which suction tube 28 has a sealed connection to the suction coupling 45 (FIG. 7) in communication with the vacuum pump's air inlet. The squeegee assembly 23 is connected to the bottom of the platform 38 in the orientation suggested in FIGS. 7 and 8. The bottom intake port 36 is seen in FIG. 7 as penetrating the top of the squeegee assembly 23. The top of the port 36 has a sealed connection with the intake flow conduit 47 which passes through, and is supported on, the platform 38, as seen in FIG. 7. FIG. 8 depicts the conduit aperture 49 in the platform 38, through which the squeegee assembly's bottom intake port 36 extends to its sealed connection with the bottom end of the intake flow conduit 47. The intake flow conduit 47 is in fluid communication with the intake flow tube 25 (FIGS. 1-5) via an intake flow coupling 48 shown in FIG. 7. The intake flow coupling 48 of the conduit 47 is in sealed connection with the intake flow tube 25. Spent cleaning solution accordingly may be sucked from the floor through the bottom intake port 36, then through the platform 38 and to the intake flow coupling 48 via the intake flow conduit 47.

Electrical power for the various pumps and motors is provided by a bank of lithium ion batteries. The battery pack 53 is seen in FIG. 7. The battery pack 53 is mounted centrally on the platform 38. The battery pack 53 is electrically connected to the fresh cleaner fluid pump, the vacuum motor 44 pump, and the scrubber brush motors 42 by means of conventional wiring and electrical connections known in the art but not shown in the figures. A person skilled in the art immediately appreciates also that the battery pack 53, motors 42 and pumps including the turbine vacuum motor 44, are in signal communication with the control panel 13 (FIGS. 3-4), such that the user of the apparatus 10 can readily turn on, turn off, and/or otherwise regulate their corresponding operations.

FIGS. 7 and 8 show the clean solution reservoir 34, which is mounted in the base assembly 20. The hollow reservoir 34 in overall contour may define a somewhat toroidal shape surrounding large central aperture 35. Situated atop the platform 38, the solution reservoir 34 is shaped and sized complementary to the base assembly, with the periphery of the reservoir corresponding generally to, but being somewhat less in extent, to the periphery of the platform 38. Despite being a hallow container, the clean solution reservoir 34 has an atypically complex overall shape and exterior contours, molded so to accommodate the presence of other key components (including but not limited to the motors 42 and the vacuum motor 44) upon the platform 38.

Details of the exterior shape of the dean solution reservoir 42 are provided FIGS. 7 and 8; the peripheral outside wall and the circumferential inside wall of the reservoir 42 are in most places generally parallel, with the walls joined by a top and a bottom so that the reservoir's walls, top, and bottom define there within an interior container space. In a preferred embodiment, the interior of the clean solution reservoir 34 has a fluid capacity of approximately one U.S. gallon (3.8 liters). The reservoir 34 is filled with fresh cleaning solution by means of a filler inlet 55 in its top, as seen in FIGS. 4 and 7. The filler inlet 55 is sealably but releasably closed with a cap 56 (FIG. 10), which cap may have a screwed engagement with the inlet 55. The clean solution reservoir's large central aperture 35 provides space for the battery pack 53; in a fully assembled base assembly 20, the clean solution reservoir 34 surrounds the battery pack 53 on four lateral sides while the battery pack occupies the reservoir's central aperture 35. A lid 59 is removably engageable to the top of the reservoir to close the aperture 35 and cover the battery pack 53.

FIG. 8 depicts the pump exhaust diffuser 62, which also is clearly shown in FIGS. 5 and 6. The exhaust diffuser 62 is an advantage of the apparatus 10. Diffuser 62 is mounted within and near the back of the base assembly 20, beneath the main platform 38, and behind the squeegee assembly 23. The diffuser 62 is specifically disposed adjacently below the exhaust port of the motorized vacuum pump motor 44, as indicated by FIG 8. The diffuser 62 has a plurality of spaced vanes 63 which diverge from one another (moving radially outward from the pump motor 44). The diffuser 62 baffles the exhaust from the vacuum motor 44, beneficially to muffle vacuum pump motor noise. Further and advantageously, the diffuser 62 diffuses and baffles the exhaust flow from the motor 44 to reduce the disruption (by the exhaust) of cleaning solution flow, along and in front of the squeegee assembly 23, and upward into the bottom intake port 36 (per FIG. 5). The presence of tile exhaust diffuser 62 thus reduces apparatus operation noise, and promotes a smoother flow of used cleaner solution from the floor up toward the bottom intake port 36.

Figure 9:
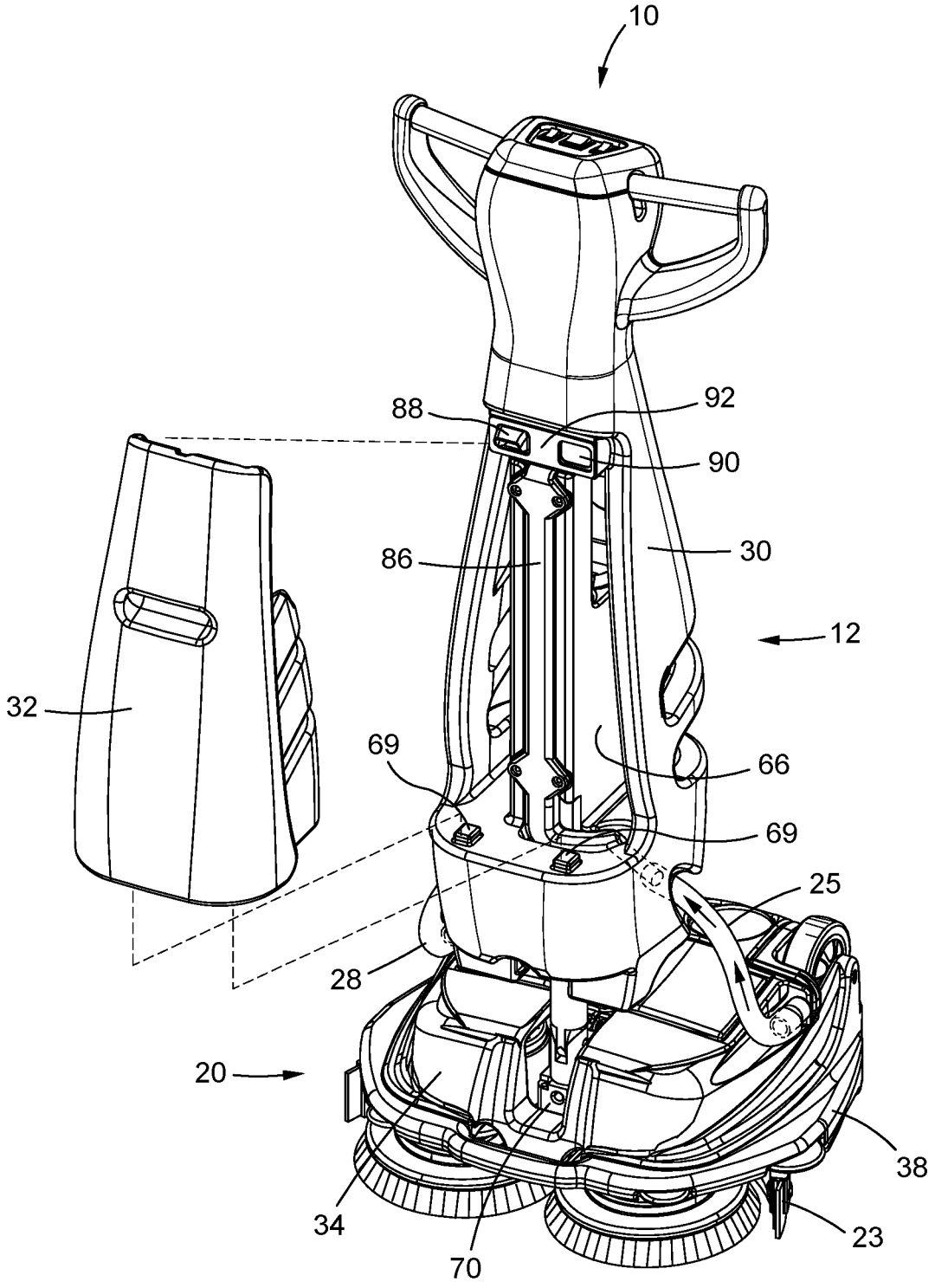
FIG. 9 is a partially exploded, perspective front view of the apparatus according to the present invention, showing that a solution recovery tank is removably insertable into a cavity within an exoskeleton of the handle assembly, and revealing certain internal elements of the handle assembly.
Figure 10:
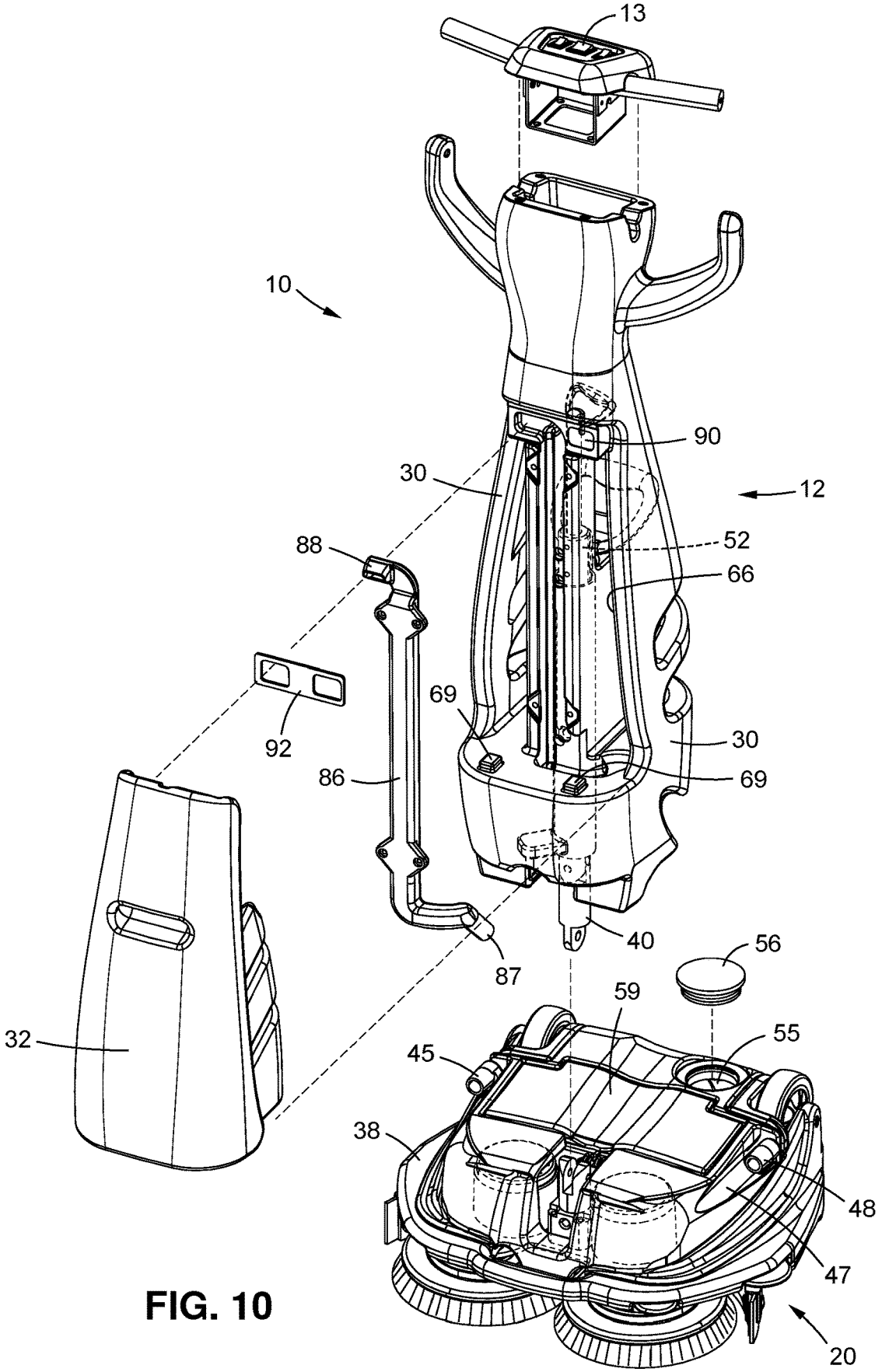
FIG. 10 is an exploded view of the apparatus, similar to FIG. 9 illustrating selected internal components of the apparatus, with certain components shown in dashed bidden lines.

FIGS. 9 and 10 illustrate that the hollow exoskeleton 30 and the specially shaped hollow recovery tank 32 are major components of the handle assembly 12. As these views indicate, the recovery tank 32 is detachably engaged with and into a recovery tank cavity 66 in the front of the exoskeleton 30. The front of the exoskeleton 30 is shaped to define therein the recovery tank cavity 66. The recovery tank 32 is provided, on the exterior of its bottom wall, with one or more. preferably at least a pair, of lock indents 68 (seen in FIG. 11). Complementarily shaped and sized protruding locking knobs 69, seen in FIGS. 9 and 10, are provided on the exoskeleton 30, below the tank cavity 66 and near its bottom. The locking knobs 69 are temporarily insertable into the recovery tank's corresponding lock indents 68 to promote a releasably locking engagement between the exoskeleton 30 and recovery tank 32. (It is readily apparent that the lock indents 68 and locking knobs 69 could be reversed in location/contour, i.e., the lock indents defined into the exoskeleton 30 and the locking knobs 69 protruding from the bottom of the tank 32.) The respective exterior peripheries of the tank cavity 66 and of the recovery tank 32 may also be configured to promote a "snapped" connection between the exoskeleton 30 and recovery tank in any suitable known manner, so that the tank 32 is controllably attachable to, and detachable from, the exoskeleton by the user. The recovery tank 32 thus is easily removed from the rest of the apparatus 10, when filled with dirty spent cleaning solution, to be emptied. It may then be replaced upon the exoskeleton 30 for further use.

Figure 11:
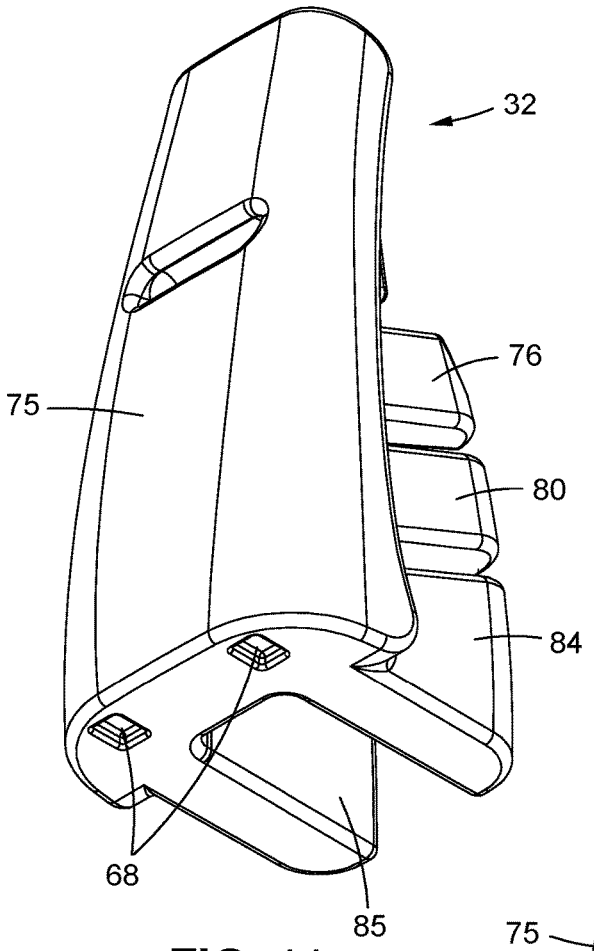
FIG. 11 is a perspective view, from below, of the solution recovery tank according to a preferred embodiment of the invention.
Figure 12:
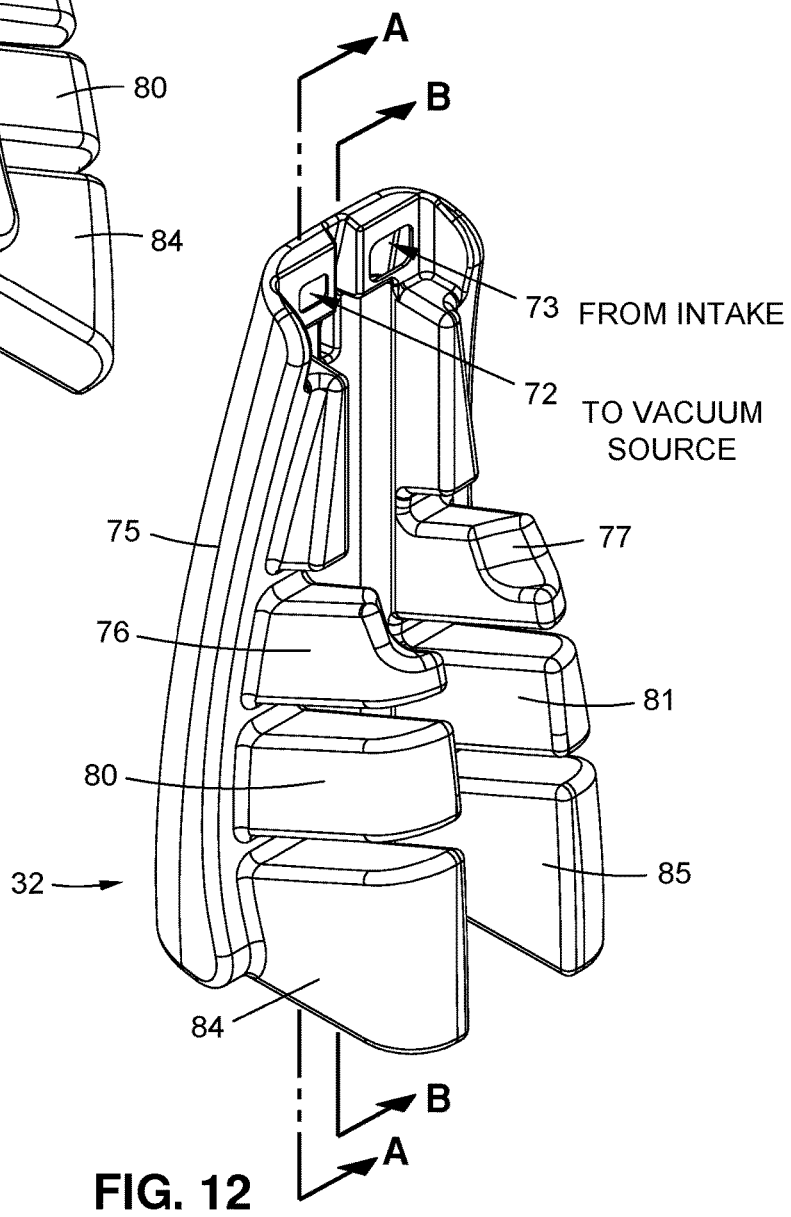
FIG. 12 is a perspective left side view of the recovery tank shown in FIG. 11.

Combined reference is made to FIGS. 11 and 12, showing details of the shape and contours of the hollow molded solution recovery tank 32 of the microscrubber 10. The shaped configuration of the recovery tank 32 supplies significant innovative advantages of the invention. The recovery tank 32 preferably is molded integrally so to be a single unit. It defines traps or chambers which serve as solution slosh baffles as well as inhibiting accidental flooding of the vacuum motor 44 (as shall be described further). As suggested by the drawing figures, including FIG. 15, the recovery tank 32 preferably but not necessarily is bilaterally symmetrical in respect of its central vertical axis. Recovery tank 32 has a front hollow, main body 75 from which a plurality of hollow chambers 76, 77, 80, 81, 84, 85 distend rearwardly and mildly upwardly. "Rearward" means opposite the direction of apparatus travel during use, i.e., toward the right in FIGS. 2, 13 and 16A-D. The main body 75 is elongated, with its principal axis about vertical when the handle assembly 12 is in a vertically upright position.

Figure 13:
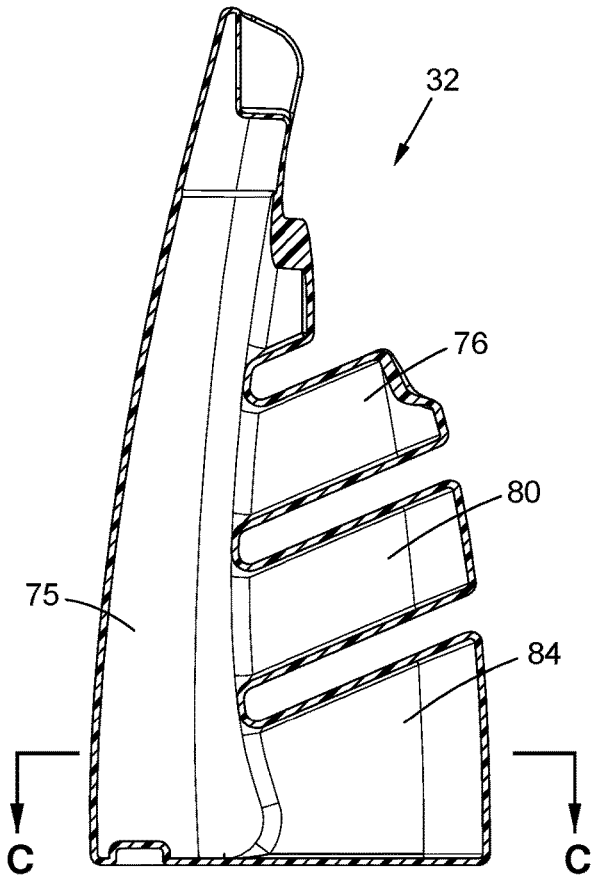
FIG. 13 is a side sectional view of the recovery tank, taken along, section plane A-A of FIG. 12.
Figure 14:
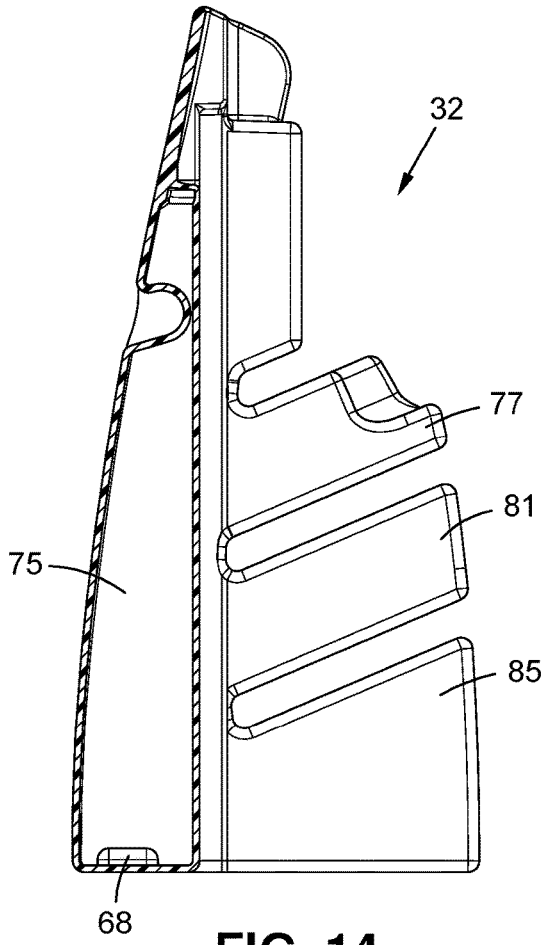
FIG. 14 is a side sectional view of the recovery tank, taken along section plane B-B of FIG. 12

Further, we have determined that the mildly upward distension of the chambers 76, 77, 80, 81, 84, 85 is an angular tilt or slop, when the handle assembly 12 and recovery tank are vertically upright of between 15° and 30° degrees, preferably between 20° and 25° , from the horizontal floor. For example, the top walls of the lower chambers 84, 85 preferably are about parallel to the top and bottom walls of the medial chambers 80, 81, which preferably are about parallel to the top and bottom walls of the upper chambers 76. 77, as seen in FIGS. 13 and 14, and the foregoing walls preferably define an angle of 23° with the horizontal floor. As suggested in FIGS. 13 and 14 the bottom walls of the bottom chambers 84, 85, are approximately horizontal (and coplanar with the bottom of the main body 75) when the handle assembly is vertically upright.

The hollow chambers 76, 77, 80, 81, 84, 85 thus distend from the main body 75, and their respective hollow interiors freely communicate fluidly with the interior of the main body 75. There preferably is a matching pair of upper chambers, being a left upper chamber 76 and a right upper chamber 77, that are spaced laterally to the sides of the central axis of the handle assembly, as suggested FIG. 12. Similarly, there preferably is provided a matched pair of medial chambers, being a left medial chamber 80 and a right medial chamber 81, that likewise are spaced laterally to the sides of the central axis of the handle assembly. Finally, there preferably is provided a matched pair of lower chambers, being a left lower chamber 84 and a right lower chamber 85, as seen in FIGS. 11 and 12. The upper chambers 76, 77 correspond generally in elevation (e.g., vertically relative to the floor when the handle assembly is upright) to an upper portion of the main body 75, the medial chambers 80, 81 correspond elevationally with a middle portion of the main body, and the lower chambers 84, 85 correspond elevationally with a lower portion of the main body of the recovery tank 32.

It is seen in FIG. 12 that in a preferred embodiment each pair of chambers is connected to, but also separated by, the main body 75. Thus, fluid does not flow directly between the left upper chamber 76 and the right upper chamber 77; rather, fluid flows to/from the interiors of the upper chambers 76, 77 via the intermediate main body 75. Likewise, fluid does not flow directly between the left medial chamber 80 and the right medial chamber 81. Instead, fluid flows to/from the medial chambers 80, 81 via the intermediate main body 75. Similarly, the lower chambers 84, 85 are not in direct fluid communication with each other; only via the intermediate main body. When the recovery tank 32 is detachably engaged into the exoskeleton 30, the chambers 76, 77, 80, 81, 84 85 are accommodated within the cavity 66 of the exoskeleton 30, as suggested by hidden lines in FIGS 3-5, as well as FIGS. 9, 10, 18 and 19.

The recovery tank front main body 75 is hollow to provide a container cell into which spent cleaning solution is deposited after being recovered from the floor below the base assembly 20 (in a manner to be further elaborated). The recovery tank chambers 76, 77, 80, 81, 84, and 85 also define hollow interiors. The interior spaces of the tank chambers 76, 77, 80, 81, 84, 85 are in fluid communication with the interior of the front main body 75 such that fluids, particularly cleaning solution liquids, can flow from within the inside of the recovery tank front portion into each of the interiors of the tank chambers when the handle assembly 12 is tilted (in a manner to be described further hereinafter). In the preferred embodiment of the solution recovery tank 32, each of the Chambers 76, 77, 80, 81, 84, 85 has its own separate fluid communication with the interior volume of the main body 75 of the recovery tank 32.

As seen in FIG. 12 and 13, the interior volumes of the lower chambers 84, 85 preferably exceed the interior volumes of the medial chambers 80, 81, which volumes in turn preferably are greater than the interior volumes of the upper chambers 76, 77. Consequently, the combined liquid capacities of the lower chambers 84, 85 are greater than the combined capacities of the medial chambers 80, 81, and the combined capacities of the medial chambers 80, 81 are greater than the combined capacities of the upper chambers 76, 77.

Figure 15:
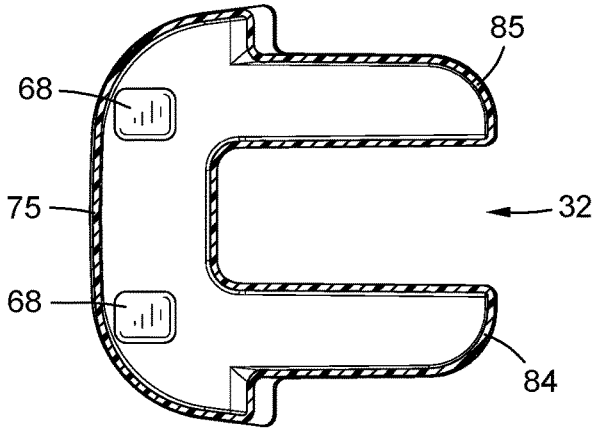
FIG. 15 is transverse sectional view of the recovery tank, taken from above along section plane C-C of FIG. 13.

Combined reference to FIGS. 13-15, being sectional views, provides additional understanding of the geometries of the lobed recovery tank 32. FIG. 13 shows how where the left-side chambers 76, 80, and 84 conjoin the tank main body 75, the walls of the chambers 76, 80, and 84 extend directly from the rear of the body 75. (A vertical cross section of the right-side chambers 77, 81, 85 would be essentially identical to the vertical section of the left side of the tank 32 shown in FIG. 13.) Any liquid deposited into the upright main body 75 flows concurrently into the bottom chambers 84, 85, as their floors of bottom walls preferably are coplanar. (FIGS. 11, 13). FIG. 15, a horizontal sectional view taken from FIG. 13, depicts the broadly open fluid communication between the bottom interior of the main body 75 and the respective bottom chambers 84, 85. FIG. 13 also suggests how liquids within the interior of the main body 75 can pour or flow freely into the respective interiors of the medial chambers 80, 81 and of the upper chambers 76, 77 if the recovery tank 32 is tipped or tilted significantly rearward (i.e., toward the right in FIGS. 13-14). Such poured flow is first into the medial chambers 80, 81 and successively into the upper chambers 76, 77 as a tipping is continued and deepened.

Combined attend on to FIGS. 11-15 depicts that in an intermediate central region of the recovery tank 32, the left-side chambers 76, 80, and 84 are laterally spaced from the right-side chambers 77, 81, 85. In this intermediate region, there is only the front main body 75, seen in section in FIG. 14—which is fillable with liquids as well, as the front portion defines an integral large chamber—which is a hollow bridge joining the left-side chambers 76, 80, and 84 to the right-side chambers 77, 81, 85. The open separation space between the left-side chambers 76, 80, 84 and the right-side chambers 77, 81, 85 accommodates the presence of other centrally and axially situated components of the handle assembly 12, including, the structural main handle shaft 52 and a recovery conduit 86.

Reference is returned to FIGS. 9 and 10, depicting certain internal components and features of the microscrubber 10 for conveying cleaning solution through the apparatus system within the handle assembly 12. Helpful attention may also be paid to FIG. 12, which shows the tank vacuum port 72 and the tank solution inlet port 73 defined in the top part of the recovery tank 32. By "top part" we mean the portion of the recovery tank 32 elevationally above the upper chambers 76, 77, and within about 6-8 inches of the topmost extent of the recovery tank. The intermediate recovery conduit 86 is disposed in the handle assembly 12 to convey contaminated spent cleaning solution from the base assembly 20 upward and into the recovery tank 32. A lower conduit inlet 87 of the recovery conduit 86 seen in FIG. 10, has a sealed connection with the upper end of the intake flow tube 25, so to be in fluid communication with the intake flow coupling 48 at the base assembly 20. The inter mediate recovery conduit's upper conduit outlet 88 is configured to deliver spent cleaning solution to the tank solution intake port 73 (FIG. 12) of the recovery tank 32. FIG. 10 also depicts a vacuum transfer port 90 defined in an upper portion of the exoskeleton 30. The vacuum transfer port 90 is an access to the hollow interior of the exoskeleton 30. As also indicated in FIG. 3, the recovery tank's tank vacuum port 72 is alignable or registrable with the exoskeleton's vacuum transfer port 90. The vacuum transfer port 90 thus is seen preferably to be defined in an upper portion of the exoskeleton, and the vacuum port 72 preferably is defined an upper portion of the recovery tank 32, and the vacuum transfer port is releasably yet sealably engageable with the recovery tank's vacuum port. The recovery tank's tank solution intake port 73 also is alignable with the upper conduit outlet 88, as indicated in FIGS. 3, 9, 10, and 12.

When the recovery tank 32 is in its use position (FIGS. 1-5 and 18), disposed into the exoskeleton's tank cavity 66 and engaged with the exoskeleton 30 body the recovery tank's tank vacuum port 72 has a sealed communication directly with the vacuum transfer port 90. By means of the operable connection between the vacuum transfer port 90 and the tank vacuum port 72, the reduced pressure within the interior of the exoskeleton 30 automatically induces a corresponding reduced pressure (vacuum) within the interior of the recovery tank 32. Referring particularly to FIG. 10, a window gasket 92 improves the sealed connection between the upper portion of the exoskeleton 30 and the upper portion of the solution recovery tank 32, and surrounding the ports 72, 73, 90, when the recovery tank is removably attached into and onto the exoskeleton. The upper conduit outlet 88 passes through one of the two apertures in the gasket 92, as suggested in FIG. 9, when the handle assembly 12 is completely assembled and configured for use.

Figures 16A, 16B, 16C, 16D:
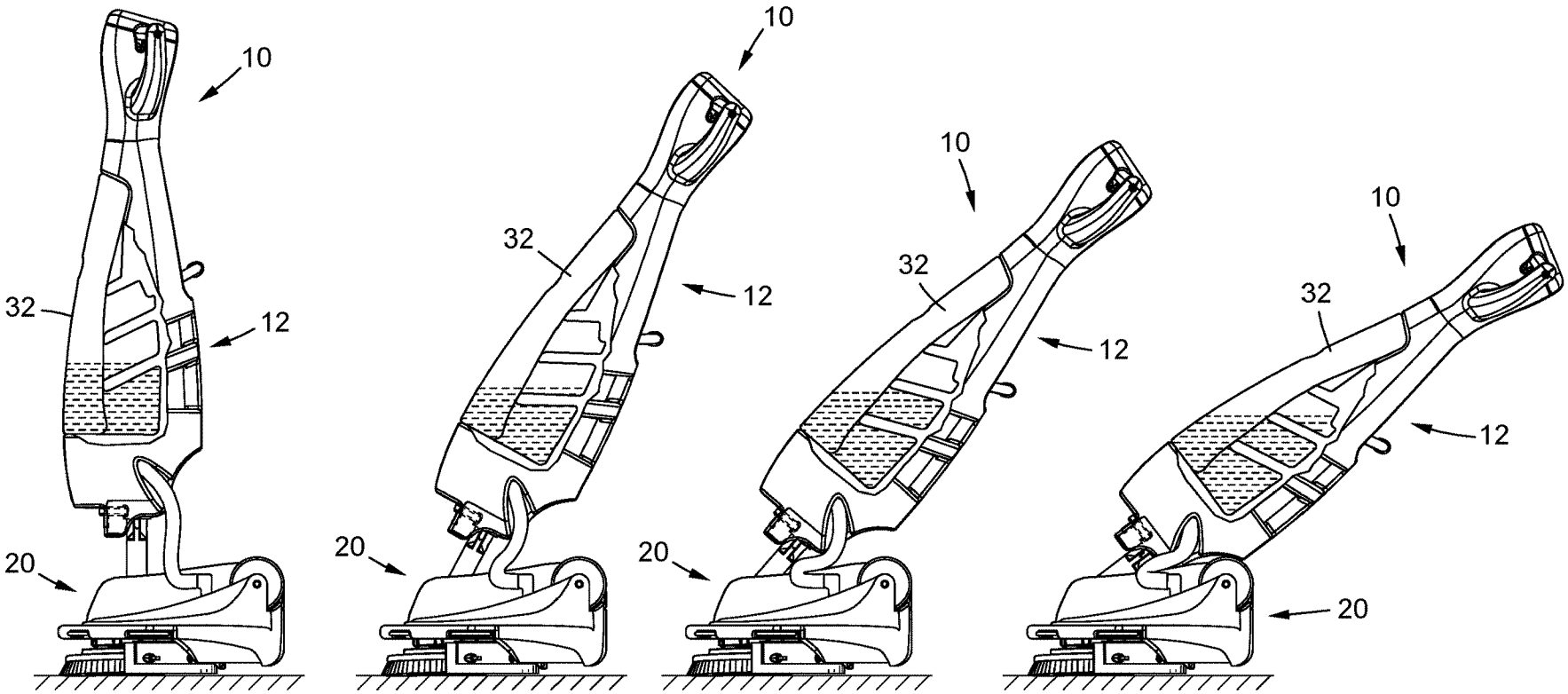
FIGS. 16A-D are left-side views of an apparatus according to the present invention, illustrating in the serial the handle assembly being tilted progressively further backward, and depicting in dashed hidden lines the resulting effect upon a solution within the solution recovery tank.

Combined reference is made to FIGS, 1-5, 9, 10, and 12. The recovery tank 32 is for receiving spent cleaning solution sucked from the floor via the base assembly 20. During the operation of the microscrubber 10 to clean a floor, the vacuum motor 44 is actuated to pull air from the interior of the exoskeleton 30 (i.e., pull a partial vacuum) via the suction coupling 45 and vacuum suction tube 28 (dashed directional arrows in FIGS. 3 and 4). Air is exhausted from the bottom of the vacuum motor 44, beneath the base assembly's main platform 38. As the pressure is thus substantially reduced within the exoskeleton 30, so too is a corresponding vacuum pulled within the interior of the recovery tank 32, via the sealed communication of the vacuum transfer port 90 with the tank vacuum port 72. The reduced pressure within the recovery tank 32 in turn pulls a corresponding vacuum within the recovery conduit 86 which is in sealed communication with the intake flow tube 25. As explained previously, the intake flow tube 25 has fluid communication with the bottom intake port 36 by means of the intake flow conduit 47 (FIG. 7). Consequently, cleaning solution previously applied to the floor, and which has collected in front of the squeegee assembly 23, is sucked up into the bottom intake port 36 (directional arrows in FIG. 5). The vacuum action produced from the inside of the recovery tank 32 sucks the contaminated cleaning solution upward through the intake flow conduit 47 to the intake flow coupling 48, therefrom along the intake flow tube 25 (solid directional arrows in FIGS. 1, 2, 4, 5, and 9), and then upward through the recovery conduit 86 (vertical upward directional arrows in FIG. 3). Thus there is provided a means for conveying spent cleaning solution, the means including at least the recovery conduit 86, its upper conduit outlet 88 configured to deliver spent cleaning solution to the solution intake port 73, and its a lower conduit inlet 87 in sealed connection with an upper end of an intake flow tube 25. When the intake cleaning fluid flow in the recovery conduit 86 reaches the upper conduit outlet 88, the spent cleaning fluid pours therefrom into the interior of the recovery tank 32 (see FIG. 3), where it accumulates for later controlled emptying and disposal. FIG. 16A shows the microscrubber 10 in an upright orientation with the recovery tank 32 partially filled with used cleaning solution after a time period of use.

A commonly encountered problem with microscrubber devices is the threat that spoiled spent cleaning solution accumulated in a recovery tank poses to the device's vacuum pump motor. In some devices there is a vent aperture in or near the top of the device's recovery tank; the aperture often is present to permit the transmission of air or solution to the recovery tank. Because the aperture is near the top of the recovery tank, cleaning fluids do not usually exit the recovery tank via the aperture. As mentioned, microscrubbers also typically are equipped with a handle assembly that is tiltable relative to the base assembly. This tiltability feature is desirable, as it promotes easy and efficient operation of the microscrubber during use, as the operator moves and steers the microscrubber across the floor, and around furniture and other obstructions. But the convenient tilting or pivoting of the handle assembly increases the risk that dirty cleaning solution may spill accidentally from the top of the recovery tank, and flow to and damage the vacuum pump motor. Thus, if the microscrubbers handle assembly is tipped or tilted significantly toward the horizontal with a large volume of solution accumulated within the recovery tank (the recovery tank is near full), solution may leak from the vent aperture, and flow down to the exterior of, or air intake of, the vacuum pump, or otherwise short or damage its motor or other components. Liquid cleaning solution and/or foams coming into improper contact with the vacuum motor may damage the pump motor.

FIGS. 16A-D, considered in seriatim, illustrate an advantage of the invention whereby the configuration of the recovery tank 32 ameliorates the risk of spent cleaning solution or lathered foam spilling from the tank vacuum port 72 to threaten the vacuum motor 44. FIG. 16A depicts the microscrubber 10 in a generally upright condition, with the handle assembly 12 oriented approximately (e.g., within about 10°) vertically. Dashed lines show that a substantial amount of spent cleaning solution and/or wet foam has accumulated within the recovery tank 32. In FIG. 16A, the spent solution fills a lower portion of the recovery tank main body portion 75, as well as filling completely the tank's lower chambers 84, 85. FIG. 16A also shows that the cleaning solution has just begun to reach and fill the medial chambers 80, 81.

It may happen that the user of the microscrubber 10 has occasion, during the use of the apparatus, deliberately to tilt the handle assembly 12 rearward (e.g., to about 65° from horizontal floor), as suggested by FIG. 16B. (Such tilting may be either directly toward the rear, or perhaps rearward while the handle assembly 12 is concurrently being pivoted laterally to one side or the other.) As suggested FIG. 16B, such tilting action results in cleaning solution flowing from the recovery tank's front main body 75 into the medial chambers 80, 81. The presence of the medial chambers 80, 81 and their ample interior volumes prevents the level of cleaning solution from rising immediately upward along the main body 75 of the tank 32 toward the tank vacuum port 72—thus safeguarding against solution flooding the vacuum motor 44. If, or as, the quantity of cleaning solution in the recovery tank 32 remains approximately constant, but the handle assembly 12 is pivoted progressively further backward toward the horizontal, spent cleaning fluid will flow from the central middle portion of the tank main body 75 successively into the medial chambers 80, 81 and upper chambers 76, 77. Continued angular rearward pivoting of the handle assembly 12 thus simultaneously tilts the recovery tank 32 so that cleaning solution accumulated within the recovery tank 32 pours from the tank main body 75 first into the medial chambers 80, 81, and then (with further tilting) into the upper chambers 76, 77. The vertical separation of the upper chambers 76, 77 from, and above the medial chambers 80, 81 promotes this serial filling of the upper chambers after the medial chambers have filled. The substantial additional capacities of the medial chambers 80, 81, and upper chambers 76, 77—particularly because those chambers 76, 77, 80, 81 extend angularly upward and rearwardly (e.g., FIG. 13) from the tank front main body 75—substantially inhibit the spent solution from reaching the upper portions of the recovery tank 32. For solution to reach the tank vacuum port 72 due to the leaning of the handle assembly 12 (aided by the low pressure within the exoskeleton) solution must first fill much or all of four tank chambers 76, 77, 80, 81 (the lower Chambers 84, 85 having previously filled.)

As seen in FIGS. 16C and 16D additional quantities of used cleaning solution are managed oy the recovery tank 32, even if and when the handle assembly 12 is tilted even more deeply backward toward the floor. FIG. 16C shows increased volume of accumulated cleaning solution within the handle assembly 12 tipped even further backward (e.g., to about 50° from floor), and the spent cleaning fluid substantially fills the medial chambers 80, 81. Any further tilting of the handle assembly 12 (e.g., to about 45°, or even less, from horizontal), with the medial chambers 80, 81 filled, results in additional cleaning solution flowing from the recovery tank main body 75 into the upper chambers 76, 77, as indicated in FIG. 16D. A person skilled in the art immediately appreciates that the handle assembly 12 can be tilted even closer to the horizontal floor, yet accumulated cleaning solution cannot and will not reach the uppermost portions the recovery tank 32 unless and until fluid fills and "overtops" the upper chambers 76, 77 to spill into the topmost region of the recovery tank. By the foregoing means, therefore, the risk of accidental flooding of, and potential damage to, the vacuum motor 44—by deliberate or accidental dropping of tilting of the handle assembly 12 and its recovery tank 32—is significantly reduced.

In view of the foregoing, therefore it is evident that the lobed or chambered configuration of the recovery tank 32 safeguards against spent cleaning solution flooding the vacuum motor 44. During operation of the microscrubber 10 spent solution pours first into the lower volume or portion of the main body 75, as well as (concurrently) into both lower chambers 84, 85. If at an early stage of microscrubber operation the assembly 12 is steeply tilted, either deliberately or accidentally, spent solution accumulated in the lower portion of the recovery tank 32 will flow not up to the tank vacuum port 72, but rather will be contained in the ample volume of the lower chambers 84, 85. With continued operation of the microscrubber 10, spent solution progressively fills not only the lower portion of the recover tank's main body 75, but simultaneously also fills the lower chambers 84, 85. If the lower chambers 84, 85 thereafter are fully filled, as seen in FIG. 16A ongoing operation of the microscrubber will gradually further fill not only the recovery tank main body 75, but will also begin filling the medial chambers 80, 81, as illustrated in FIG. 16A. If at that subsequent time the handle assembly 12 is tilted, spent solution accumulated in the lower portion of the main body 75 and the lower chambers 84, 85 will flow not up to the tank vacuum port 72, but rather will pour into and be contained in the volumes of the medial chambers 80, 81.

With still further continued operation of the microscrubber 10, additional spent solution progressively fills not only the lower portion of the recover tank's body 75 and the lower chambers 84, 85, but will fill the elevationally middle volume of the main body 75 and some of the volume of the medial chambers 80, 81. If, at that second subsequent time, the handle assembly 12 is tilted, spent solution accumulated in the main body 75 (particularly the middle portion) and the medial chambers 80, 81 will not flow up to the tank vacuum port 72, but rather will pour into and be contained in the volumes of the upper chambers 76, 77. It is seen, therefore—and as suggested by FIG. 6D—even if the medial chambers 80, 81 are mostly filled because the contents of the clean solution reservoir 34 have mostly been delivered to the recovery tank 32 due to prolonged operation of the microscrubber, severe tilting of the handle assembly 12, may not result in spent solution flowing deleteriously out the tank vacuum port. Instead, spent solution in the middle portion of the tank 32 and the medial chambers 80, 81 pours into and is held within the upper chambers 76, 77. The microscrubber 10 may be configured by design such that the total capacity of the clean solution reservoir 34 is limited to be less than the effective capacity of the recovery tank 32 when extremely tilted (i.e., to about 45' from horizontal), so that spent solution almost never accidentally escapes the recovery tank to flow to the vacuum motor 44.

The recovery tanks 32 accordingly can hold an advertised capacity of spent solution, and yet be tilted (even to surpass the actual practical operating range of motion of the handle assembly) without solution flowing back out or to the vacuum source. And during or when the handle assembly 12 is significantly tilted including as seen in FIGS. 16A-D, the chambers 76, 77, 80, 81, 84, 85 also serve as wave breaks to lessen the wave amplitudes of solution sloshing within the recovery tank 32.

There is provided, accordingly, a scrubber apparatus 10 for cleaning floors, and the apparatus has a base assembly 20 disposable upon a floor (FIG. 16A) and a handle assembly 12 extending upwardly from the base assembly, with the handle assembly being pivotally connected to the base assembly so the handle assembly is disposable in an upright position in relation to the floor (FIG. 16A), or releasable for pivotal movement in relation to the floor (e.g., FIGS. 16B-D). A preferred embodiment of the apparatus 10 includes a hollow exoskeleton 30, on the handle assembly 12 with the exoskeleton defining a vacuum transfer port 90, a vacuum motor 44 for reducing pressure within the exoskeleton and a hollow recovery tank 32 (on the handle assembly) for receiving spent cleaning solution. The recovery tank 32 preferably has a main body 75 from which a plurality of chambers 76, 77, 80, 81, 84, 85 distends rearwardly and upwardly, the plurality of chambers including at one lower chamber, and at least one medial chamber, and at least one upper chamber. The recovery tank 32 also defines a vacuum port 72 in fluid communication with the vacuum transfer port 90, and a solution intake port 73.

A preferred embodiment of the scrubber apparatus 10 also features a clean solution reservoir 34 from which an unused cleaning solution is applicable to the floor, a bottom intake port 36 in the base assembly 20, and some means for conveying spent cleaning solution from the bottom intake port to the solution intake port 73. By the foregoing, a reduced pressure within the exoskeleton 30 induces, via a suction through the vacuum port 72, reduced pressure within the recovery tank 32, thereby sucking spent cleaning solution from the floor, via the bottom intake port 36 and the means for conveying spent cleaning solution, to the solution intake port 73. Moreover, when the handle assembly 12 is in the upright position (e.g., FIGS. 1-4), spent solution received progressively into the recovery tank 32 serially fills first a lower portion of the main body 75 and the at least one lower chamber, then fills a middle portion of the main body and the at least one medial chamber, and then fills an upper portion of the main body and the at least one upper chamber. As the handle assembly 12 is pivoted increasingly from the upright position toward the horizontal, any spent solution in the at least one lower chamber or the lower portion of the main body pourably flows into the at least one medial chamber. And when the handle assembly 12 is pivoted increasingly further from the upright position toward the horizontal, any spent solution in the at least one medial chamber or the middle portion of the main body pourably flows into the at least one upper chamber.

The vacuum transfer port 90 preferably is defined in an upper portion of the exoskeleton 30, and the vacuum port 72 is defined in a top part of the recovery tank 32, the vacuum transfer port being releasably yet sealably engageable with the vacuum port. In a preferred embodiment, the means for conveying spent cleaning solution may include a recovery conduit 86. A recovery conduit 86 optionally includes an upper conduit outlet 88 configured to delver spent cleaning solution to the solution intake port 73, as well as a lower conduit inlet 87 in sealed connection with an upper end of an intake flow tube 25 in fluid communication with the bottom intake port 36. A suction tube in fluid communication with the vacuum motor 84 and the interior of the exoskeleton 44 serves as a means for pulling a vacuum from the vacuum motor and within the exoskeleton. The vacuum motor 44 preferably is in the base assembly 20, and the base assembly also optionally but preferably has an exhaust diffuser 62 mounted within the base assembly for baffling exhaust from the vacuum motor.

As discussed previously, the exoskeleton 30 of the handle assembly 12 despite having somewhat convoluted shape and contours, defines a hollow interior which serves to containerize fluids, both gasses and liquids. The vacuum within the interior of the exoskeleton 30 is communicated to the inside of the recovery tank 32 by means of the tank vacuum port 72 (FIG. 12), to reduce the pressure within the recovery tank, as disclosed hereinabove. It is possible, therefore, for solutions and foams accumulated within the recovery tank 32 to spill undesirably from the recovers tank 32, through the tank vacuum port 72 and vacuum transfer port 90, into the exoskeleton interior particularly when the recovery tank is filled near to its capacity, and the handle assembly 12 is titled significantly backward.

In the present apparatus, however, the exoskeleton's capability to receive and contain liquids permits it to serve as a secondary "reserve" recovery tank to safeguard further against inadvertent flood damage to the vacuum motor 44. Attention is advanced to FIG. 17, which offers detail regarding this beneficial aspect of the microscrubber apparatus 10. More particularly, any liquids or foams which happen to escape from the recovery tank 32 are caught and collected within the interior of the exoskeleton 30. Cleaning solution liquids or foam spilled into the interior of the exoskeleton 30 are returned to the recovery tank 32 for proper disposal, rather than contacting and affecting the vacuum pump motor.

Figure 17:
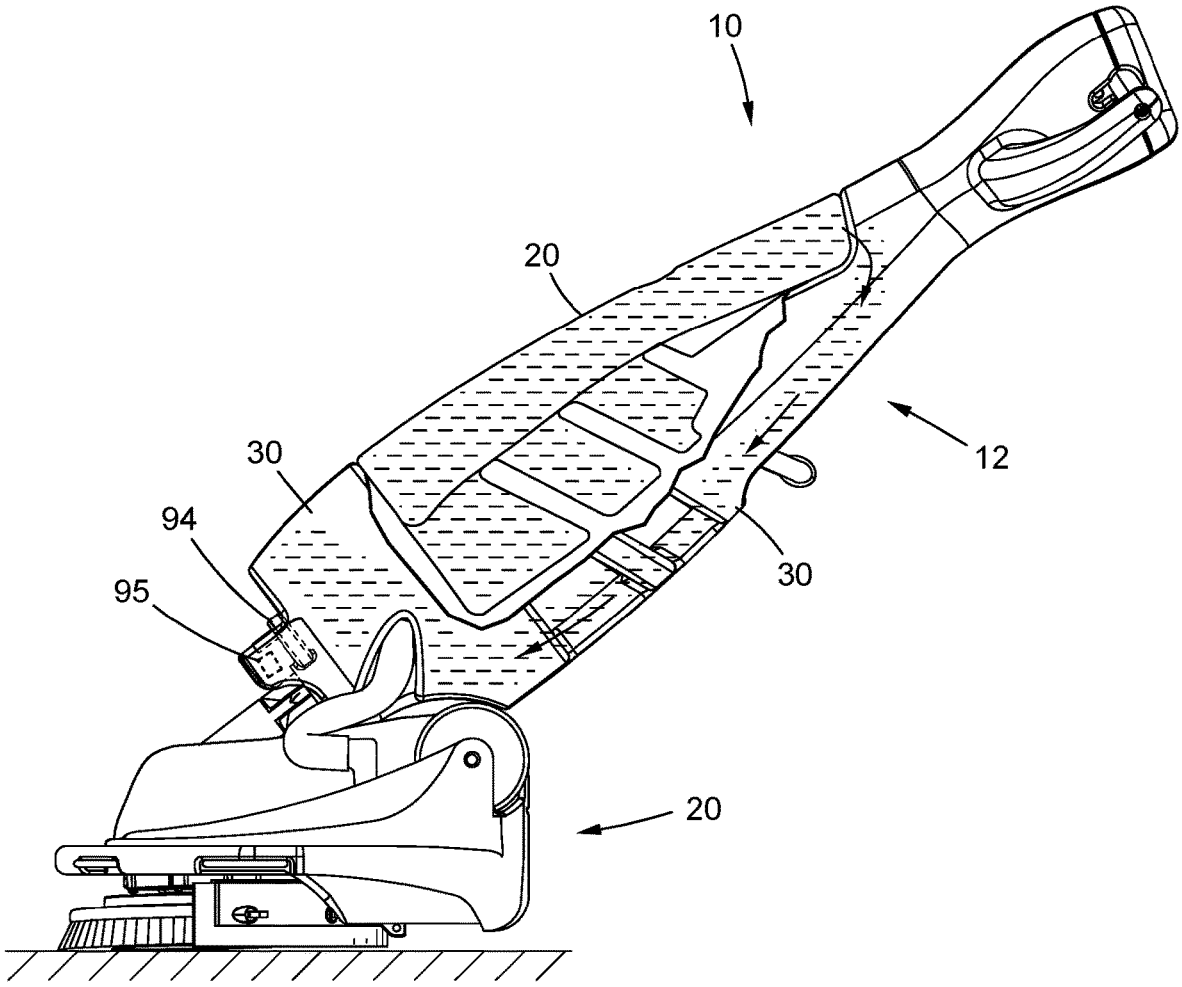
FIG. 17 is a left side view of the apparatus according to the present invention, with certain components illustrated with hidden lines, and with solution contained in the handle assembly depicted with horizontal dashed lines, and illustrating the flow of solution from the recovery tank and into the hollow exoskeleton.

As explained in the discussion of FIGS. 16A-D, the handle assembly 12 can be and frequently is tilted (deliberately, of sometimes accidentally) a significant degree backwards and toward the horizontal. FIG. 17 depicts the handle assembly 12 tilted through a substantial angle backwards, and shows used cleaning solution and/or foam as horizontal broken lines. When the handle assembly 12 is pivoted still further toward the horizontal, to an over-tilted condition (i.e., to an acute angle less than about 45° above horizontal), solution and foam accumulated in the recovery tank 32 may spill (via tank vacuum port 72 and transfer port 90 (FIG. 9)) from the top of the main body of the tank 32, after filling the upper chambers 76, 77. It is seen from FIG. 17 that any spent foam/liquid then spilling from the upper portion of the recovery tank 32 pours into the interior container of the exoskeleton 30. As depicted using directional arrows in FIG. 17, this overflow from the recovery tank 32 flows within the exoskeleton to its bottom, where it is collected and prevented from reaching and threatening the vacuum pump motor. Foam and/or solution collected within the interior of the exoskeleton 30 is detected by a float 94 in the exoskeleton which is in communication with a magnetic switch 95. The float 94 and switch 95 are of known type and function, but permit the microscrubber 10 to operate to return to the recovery tank 32 solution and foam from within the exoskeleton 30, as shall be further explained.

It is seen, therefore, that the exoskeleton 30 advantageously serves as a secondary overflow container, safeguarding against deleterious liquids and foams from backflowing toward the vacuum pump motor 44, or to other liquid-sensitive elements of the apparatus. This function is particularly desirable in the embodiment of the apparatus 10 in which the exoskeleton 30 nevertheless operates "under vacuum," i.e., with a substantially reduced internal air pressure (in relation to ambient atmospheric pressure).

Figure 18:
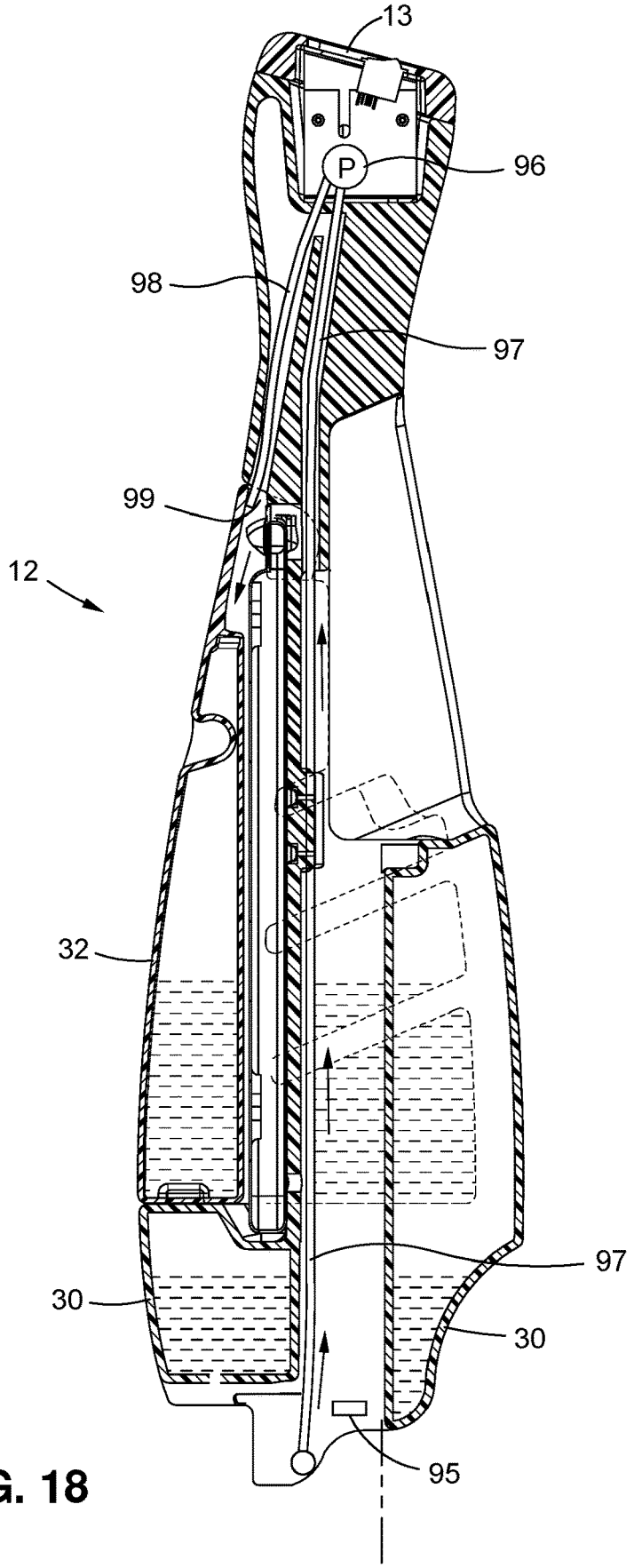
FIG. 18 is a left side sectional view of a handle assembly according to a preferred embodiment of the invention, with solution contained in the handle assembly depicted with horizontal dashed lines, and showing a return flow of solution from within the exoskeleton to the recovery tank.
Figure 19:
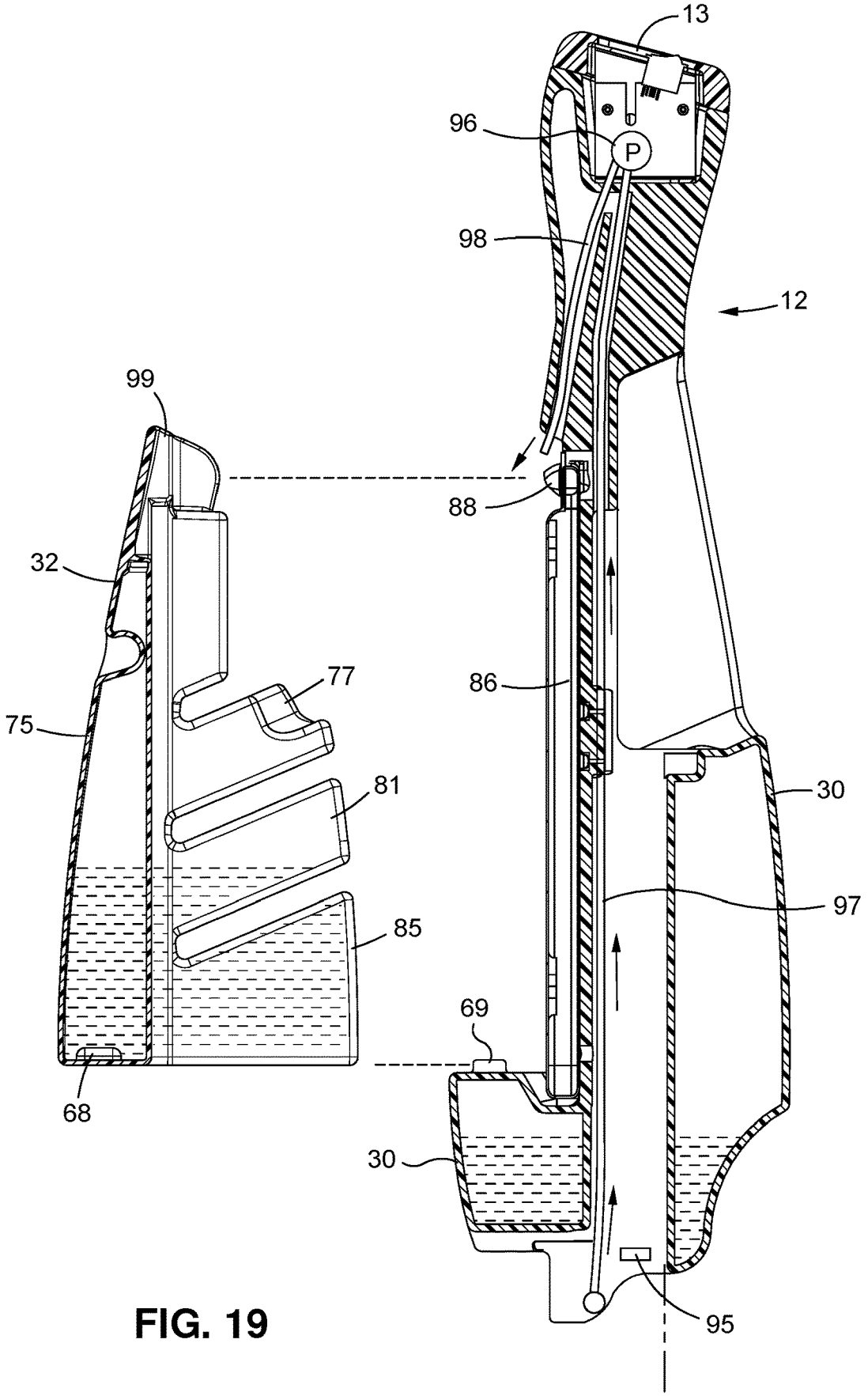
FIG. 19 is an exploded side sectional view of the handle assembly shown in FIG. 18, with the recovery tank replaceably detached from the exoskeleton, also showing a return flow of solution from within the exoskeleton to the recovery tank.

FIGS. 18 and 19 disclose a means for returning to the recovery tank 32 any spent solution, and/or foam, which happens to be collected within the interior of the exoskeleton 30. As explained with reference to FIG. 17, solution or foam spilled from the upper portion of the recovery tank 32 collects in the "backup" container defined by the hollow exoskeleton 30. Solution/foam is depicted by horizontal broken lines in FIGS. 18-19, while the figures also show in sectional profile portions of the handle assembly 12, including the exoskeleton 30 and the recovery tank 32. Foam and/or solution collected in the "reserve" tank provided by the exoskeleton 30 is returned to the recovery tank 32 by means of a pump and tubing arrangement This moisture and foam management system provides a further advantage of the presently disclosed apparatus 10

There is provided within the handle assembly 12, for example preferably near its top end below the control panel 13, a small electrically powered secondary fluid pump 96. Pump 96 may receive electrical power via wires (not shown) leading to the battery pack 53 (FIG. 7). The secondary fluid pump 96 also is in signal communication with the magnetic switch 95, such that the triggering of the switch 95 by the movement of the exoskeleton's float 94 can actuate the fluid pump 96. A first recapture conduit or tube 97 is situated within the handle assembly 12, and extends upward from the bottom interior of the exoskeleton 30 to an inlet of the secondary fluid pump 96. A second recapture tube 98, also within the handle assembly, and above the top of the recovery tank 32, extends from an outlet of the secondary fluid pump 96 to an inlet port 99 in the upper portion of the recovery tank 32. The distal end of the second recapture tube 98 is in fluid communication with the interior of the recovery tank 32, such that fluid or foam leaving the fluid pump 96 is dispensed via recapture tube 98 to the interior of the recovery tank.

Again, the exoskeleton 30 functions beneficially as a reserve tank for foam or solution overflow from the recovery tank 32. FIGS. 18 and 19 show that foam or solution that has escaped the recovery tank 32 collects inside the bottom of the exoskeleton 30. This excess foam/solution is managed by the foam management system that includes the float 94 (FIG. 17), the magnetic switch 95, the secondary fluid pump 96, and the recapture tubes 97, 98. The float 94 is in signal communication with the switch 95. Any foam or solution collected within the bottom interior of the exoskeleton 30 induces motion or a positional change in the float 94 at the bottom of the exoskeleton 30. The float's detection of foam or solution within the exoskeleton 30 triggers "on" the switch 95, which in turn signals the actuation of the secondary fluid pump 96. Upon its activation, the secondary fluid pump 96 pumps foam and/or solution from within the exoskeleton 30, and via the recapture tubes 97, 98 delivers it to the interior of the recovery tank 32, as shown by the directional arrows in FIGS. 18-19. The secondary pump 96 operates so long as the float 94 detects a significant amount of foam or solution in the exoskeleton 30. After a sufficient quantity of foam/solution has been pumped from within the exoskeleton 30 to allow the float 94 to retrograde adequately to retrigger the switch 95 to an "off" condition, the switch opens the communication circuit with the secondary pump 96, which likewise turns off and ceases pumping action. If and when foam or solution is again detected within the exoskeleton 30, the foam management system (94, 95, 96, 97, 98) is again activated to evacuate the exoskeleton interior and return the excess foam/solution to within the recovery tank 32.

Although the invention has been described in detail with reference to these preferred embodiments, other embodiments can achieve the same results. The present apparatus can be practiced by employing conventional materials and motors. Accordingly, the details of such materials, compositions, motors and pumps are not set forth herein in detail. In this description, if specific details are set forth, such as specific materials, structures, processes, etc., they are to provide a thorough understanding the present invention. However, as one having ordinary skill in the art would recognize, the present invention can be practiced without resorting strictly only to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover with the appended claims all such modifications and equivalents.

What is claimed is:

1. A scrubber apparatus for cleaning floors, the apparatus comprising a base assembly disposable upon a floor and a handle assembly extending upwardly from the base assembly, the handle assembly pivotally connected to the base assembly whereby the handle assembly is disposable in an upright position in relation to the floor, or releasable for pivotal movement in relation to the floor, the apparatus further comprising:

an exoskeleton, on the handle assembly, with a vacuum transfer port defined therein;

a vacuum motor for reducing pressure within the exoskeleton;

a recovery tank, on the handle assembly, for receiving spent cleaning solution and comprising:

a main body from which a plurality of chambers distends upwardly, the plurality of chambers comprising a pair of laterally spaced and separated lower chambers, a pair of laterally spaced and separated medial chambers, and a pair of laterally spaced and separated upper chambers;

a vacuum port in fluid communication with the vacuum transfer port; and a solution intake port;

a clean solution reservoir from which an unused cleaning solution is applicable to the floor;

a bottom intake port in the base assembly; and means for conveying spent cleaning solution from the bottom intake port to the solution intake port;

wherein reduced pressure within the exoskeleton induces, via the vacuum port, reduced pressure within the recovery tank, thereby sucking spent cleaning solution from the floor, via the bottom intake port and the means for conveying spent cleaning solution, to the solution intake port; and wherein, when the handle assembly is in the upright position, spent solution received progressively into the recovery tank serially fills first a lower portion of the main body and the at least one lower chamber, then fills a middle portion of the main body and the at least one medial chamber, and then fills an upper portion of the main body and the at least one upper chamber; and as the handle assembly is pivoted increasingly from the upright position toward the horizontal, any spent solution in the at least one lower chamber or the lower portion of the main body pourably flows into the at least one medial chamber.

2. The scrubber apparatus according to claim 1, further wherein when the handle assembly is pivoted increasingly further from the upright position toward the horizontal, any spent solution in the at least one medial chamber or the middle portion of the main body pourably flows into the at least one upper chamber.

3. The scrubber assembly according to claim 1 wherein the vacuum transfer port is defined in an upper portion of the exoskeleton, and the vacuum port is defined in a top part of the recovery tank, the vacuum transfer port being releasably yet sealably engageable with the vacuum port.

4. The scrubber apparatus according to claim 3, wherein the exoskeleton defines therein a recovery tank cavity, and the recovery tank is detachably engageable into the recovery tank cavity.

5. The scrubber apparatus according to claim 1 wherein the means for conveying spent cleaning solution comprises a recovery conduit, the recovery conduit comprising:

an upper conduit outlet configured to deliver spent cleaning solution to the solution intake port; and a lower conduit inlet in sealed connection with an upper end of an intake flow tube in fluid communication with the bottom intake port.

6. The scrubber apparatus according to claim 1 further comprising means for pulling a vacuum in an interior of the exoskeleton, with the vacuum motor, comprising a suction tube in fluid communication with the vacuum motor and the interior of the exoskeleton.

7. The scrubber apparatus according to claim 1, wherein the clean solution reservoir is disposed on the base assembly.

8. The scrubber apparatus according to claim 1, wherein the vacuum motor is in the base assembly and further comprising an exhaust diffuser mounted within the base assembly for baffling exhaust from the vacuum motor.

9. A scrubber apparatus for cleaning floors, the apparatus comprising a base assembly disposable upon a floor and a handle assembly extending upwardly from the base assembly, the handle assembly pivotally connected to the base assembly whereby the handle assembly is disposable in an upright position in relation to the floor, or releasable for pivotal movement in relation to the floor, the apparatus further comprising:

a hollow exoskeleton, on the handle assembly, having a vacuum transfer port;

a vacuum motor for reducing pressure within the exoskeleton;

a hollow recovery tank, on the handle assembly, for receiving spent cleaning solution and comprising:

a main body from which a plurality of chambers distends rearwardly and upwardly, the plurality of chambers comprising a pair of laterally spaced and separated lower chambers, a pair of laterally spaced and separated medial chambers, and a pair of laterally spaced and separated upper chambers;

a vacuum port in fluid communication with the vacuum transfer port; and a solution intake port;

a clean solution reservoir from which an unused cleaning solution is applicable to the floor;

a bottom intake port in the base assembly; and means for conveying spent cleaning solution from the bottom intake port to the solution intake port;

wherein a reduced pressure within the exoskeleton induces, via the vacuum port, reduced pressure within the recovery tank, thereby sucking spent cleaning solution from the floor, via the bottom intake port and the means for conveying spent cleaning solution, to the solution intake port; and wherein, when the handle assembly is in the upright position, spent solution received progressively into the recovery tank serially fills first a lower portion of the main body and the at least one lower chamber, then fills a middle portion of the main body and the at least one medial chamber, and then fills an upper portion of the main body and the at least one upper chamber; and as the handle assembly is pivoted increasingly from the upright position toward the horizontal, any spent solution in the at least one lower chamber or the lower portion of the main body pourably flows into the at least one medial chamber.

10. The scrubber apparatus according to claim 9, further wherein when the handle assembly is pivoted increasingly further from the upright position toward the horizontal, any spent solution in the at least one medial chamber or the middle portion of the main body pourably flows into the at least one upper chamber.

11. The scrubber assembly according to claim 10, wherein the vacuum transfer port is defined in an upper portion of the exoskeleton, and the vacuum port is defined in a top part of the recovery tank, the vacuum transfer port being releasably yet sealably engageable with the vacuum port.

12. The scrubber apparatus according to claim 11, wherein the exoskeleton defines therein a recovery tank cavity, and the recovery tank is detachably engageable into the recovery tank cavity.

13. The scrubber apparatus according to claim 12 wherein the means for conveying spent cleaning solution comprises a recovery conduit, the recovery conduit comprising:

an upper conduit outlet configured to deliver spent cleaning solution to the solution intake port; and a lower conduit inlet in sealed connection with an upper end of an intake flow tube in fluid communication with the bottom intake port.

14. The scrubber apparatus according to claim 13 further comprising means for pulling a vacuum from the vacuum motor and within the exoskeleton, comprising a suction tube in fluid communication with the vacuum motor and the interior of the exoskeleton.

15. The scrubber apparatus according to claim 14, wherein the clean solution reservoir is disposed on the base assembly.

16. The scrubber apparatus according to claim 15, wherein the vacuum motor is in the base assembly and further comprising an exhaust diffuser mounted within the base assembly for baffling exhaust from the vacuum motor.

17. A scrubber apparatus for cleaning floors, the apparatus comprising a base assembly disposable upon a floor and a handle assembly extending upwardly from the base assembly, the handle assembly pivotally connected to the base assembly whereby the handle assembly is disposable in an upright position in relation to the floor, or releasable for pivotal movement in relation to the floor, the handle assembly comprising:

a recovery tank for receiving spent cleaning solution removed from the floor via the base assembly, the recovery tank comprising:

a tank vacuum port defined in a top part of the recovery tank; and a main body from which a plurality of chambers distends upwardly, the plurality of chambers comprising at least one lower chamber, at least one medial chamber, and at least one upper chamber;

wherein the at least one lower chamber comprises a pair of laterally spaced and separated lower chambers, the at least one medial chamber comprises a pair of laterally spaced and separated medial chambers, and the at least one upper chamber comprises a pair of laterally spaced and separated upper chambers.

18. The scrubber apparatus according to claim 17 wherein, when the handle assembly is in the upright position, spent solution received into the recovery tank fills serially first a lower portion of the main body and the at least one lower chamber, then fills a middle portion of the main body and the at least one medial chamber, and then fills an upper portion of the main body and the at least one upper chamber; and as the handle assembly is pivoted increasingly from the upright position toward the horizontal, spent solution in the lower portion of the main body may pourably flow into the at least one medial chamber.

19. The scrubber apparatus according to claim 18 further comprising:

a hollow exoskeleton, on the handle assembly, having a vacuum transfer port in fluid communication with the tank vacuum port;

a vacuum motor for reducing pressure within the exoskeleton;

a solution intake port in the recovery tank;

a clean solution reservoir from which an unused cleaning solution is applicable to the floor;

a bottom intake port in the base assembly; and means for conveying spent cleaning solution from the bottom intake port to the solution intake port;

wherein reduced pressure within the exoskeleton induces, via the vacuum port, reduced pressure within the recovery tank, thereby sucking spent cleaning solution from the floor, via the bottom intake port and the means for conveying spent cleaning solution, to the solution intake port; and wherein, when the handle assembly is in the upright position, spent solution received progressively into the recovery tank serially fills first a lower portion of the main body and the at least one lower chamber, then fills a middle portion of the main body and the at least one medial chamber, and then fills an upper portion of the main body and the at least one upper chamber.

20. The scrubber apparatus according to claim 19, further wherein when the recovery tank is pivoted increasingly further from the upright position toward the horizontal, any spent solution in the at least one medial chamber or the middle portion of the main body pourably flows into the at least one upper chamber.

21. The scrubber apparatus according to claim 20 wherein, when the handle assembly is pivoted increasingly still further toward the horizontal, any spent solution in the upper portion of the main body or the at least one upper chamber of the recovery tank is spillable, via the tank vacuum port and the vacuum transfer port, from the recovery tank into the interior of the exoskeleton.

22. The scrubber apparatus according to claim 21, wherein spent solution spilling into the exoskeleton interior flows within the exoskeleton to its bottom, where it is collected and prevented from reaching the vacuum motor.

* * * * *